US007973729B2

(12) United States Patent
Bergman et al.

(10) Patent No.: US 7,973,729 B2
(45) Date of Patent: Jul. 5, 2011

(54) THIN-FILM EAS AND RFID ANTENNAS

(75) Inventors: Adam S. Bergman, Boca Raton, FL (US); Stewart E. Hall, Wellington, FL (US); Manuel A. Soto, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 56 days.

(21) Appl. No.: 11/501,499

(22) Filed: Aug. 8, 2006

(65) Prior Publication Data

US 2008/0036687 A1 Feb. 14, 2008

(51) Int. Cl.

| | |
|---|---|
| ***H01Q 11/12*** | (2006.01) |
| ***H01Q 21/00*** | (2006.01) |
| ***H01Q 1/40*** | (2006.01) |
| ***H01Q 7/08*** | (2006.01) |

(52) U.S. Cl. ..... 343/742; 343/867; 343/873; 343/788

(58) Field of Classification Search ..... 343/895, 343/788, 745, 702, 787, 741, 742, 872, 873, 343/866, 867, 878, 879, 700 MS; 340/572.7, 340/572.8

See application file for complete search history.

(56) References Cited

U.S. PATENT DOCUMENTS

| | | | | |
|---|---|---|---|---|
| 6,373,447 | B1 | 4/2002 | Rostoker et al. | |
| 7,202,790 | B2 * | 4/2007 | Copeland et al. | 340/572.7 |
| 7,446,729 | B2 * | 11/2008 | Maruyama et al. | 343/867 |
| 7,648,065 | B2 * | 1/2010 | Marino | 235/383 |
| 2002/0196146 | A1 * | 12/2002 | Moore | 340/572.7 |
| 2005/0219132 | A1 * | 10/2005 | Charrat | 343/745 |
| 2007/0001921 | A1 * | 1/2007 | Takahashi et al. | 343/788 |
| 2007/0296593 | A1 * | 12/2007 | Hall et al. | 340/572.7 |

FOREIGN PATENT DOCUMENTS

| | | | |
|---|---|---|---|
| EP | 0 854 536 | A2 | 1/1998 |
| EP | 1 439 608 | A1 | 7/2004 |
| EP | 1 445 730 | A1 | 8/2004 |
| EP | 1 633 017 | A1 | 3/2006 |
| WO | WO2006033408 | * | 3/2006 |

OTHER PUBLICATIONS

EPO International Search Report and Written Opinion dated Nov. 22, 2007 for corresponding appln PCT/US2007/017734.

* cited by examiner

*Primary Examiner* — Jacob Y Choi
*Assistant Examiner* — Robert Karacsony
(74) *Attorney, Agent, or Firm* — Alan M. Weisberg; Christopher & Weisberg, P.A.

(57) ABSTRACT

An antenna assembly is capable of being installed in a structure wherein the structure includes a covering and a substructure and the antenna assembly is configured with thin film materials to have a total thickness such that the antenna assembly can be disposed between the substructure and the covering. The antenna assembly may have a total thickness not greater than about 15 millimeters (mm), and may include at least one of a transmitter antenna, a transceiver antenna, and a receiver antenna. The receiver antenna may be configured as an air core antenna or a non-air core antenna. The receiver antenna may be configured as a non-air core receiver antenna in an internal compartment over or within a base insulating layer. The antenna assembly may be at least partially housed within a housing assembly of thin film materials so that both can be disposed between the substructure and the covering.

14 Claims, 24 Drawing Sheets

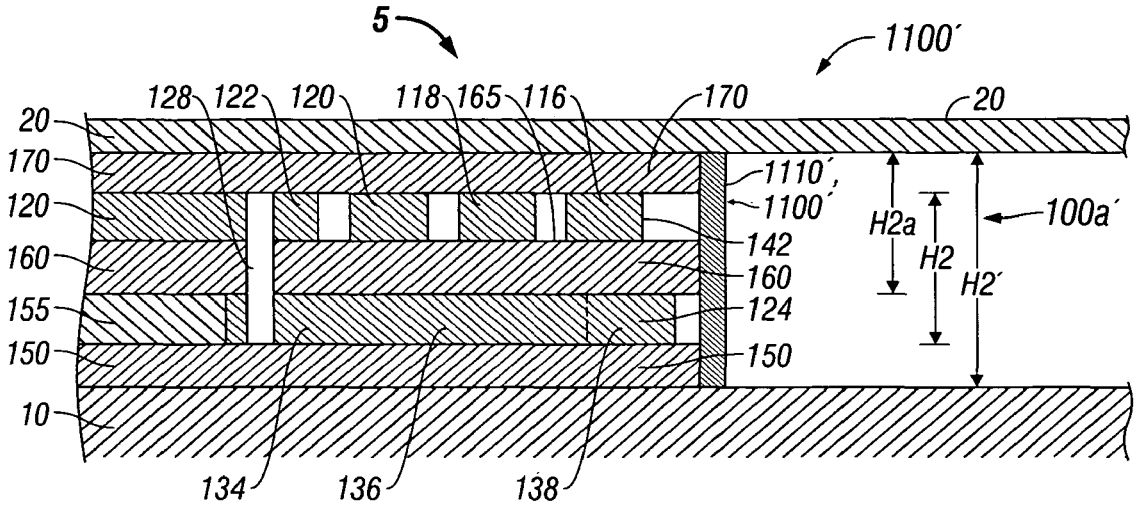
FIG. 2B
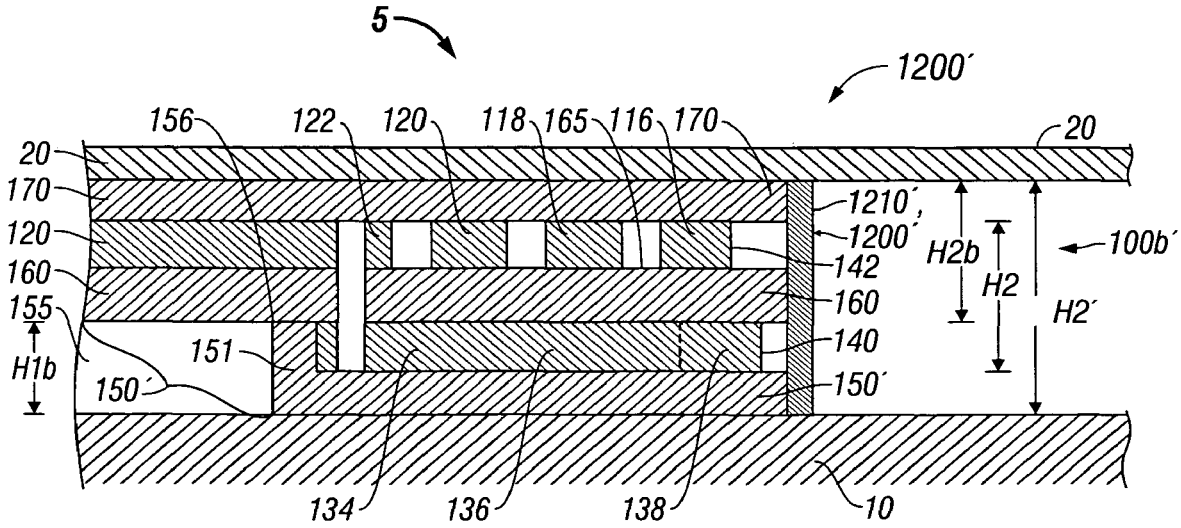
FIG. 2B´

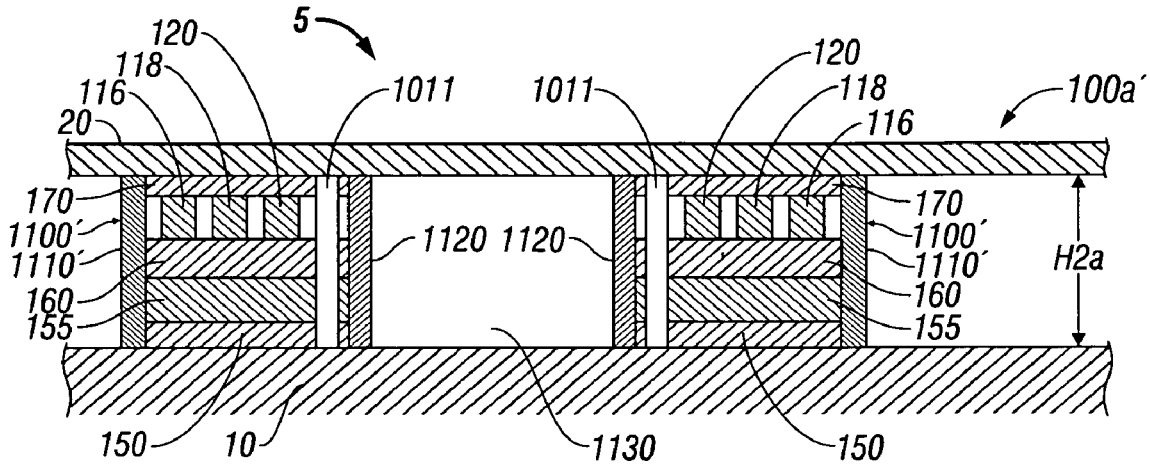
FIG. 2C
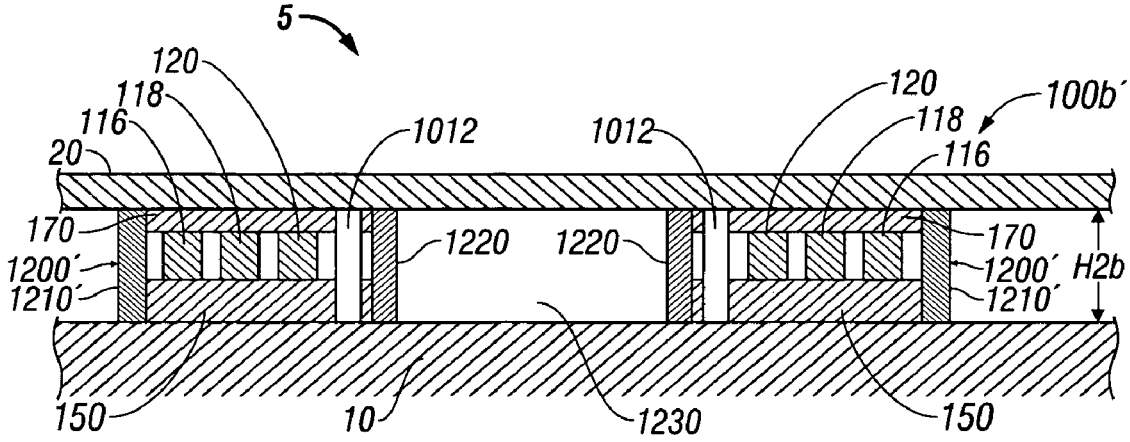
FIG. 2C´

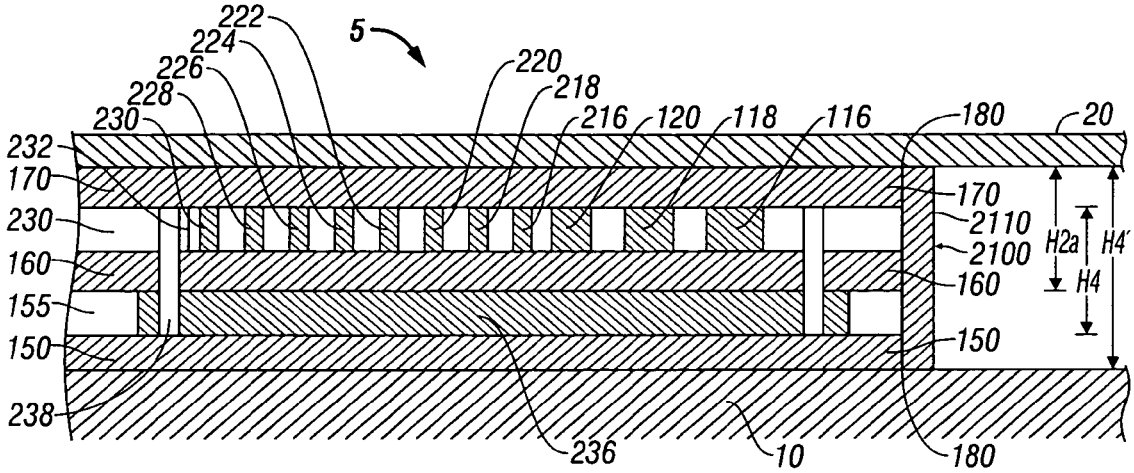
FIG. 3C
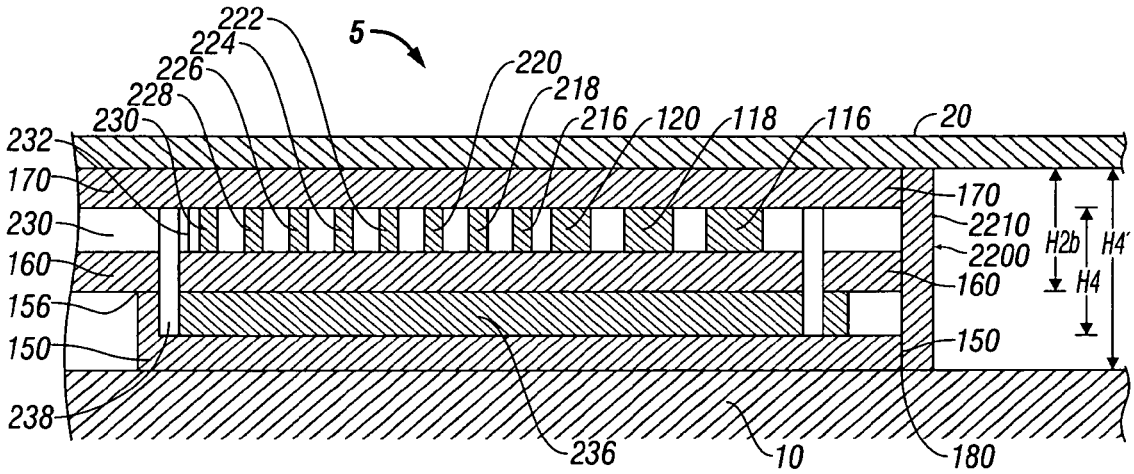
FIG. 3C´

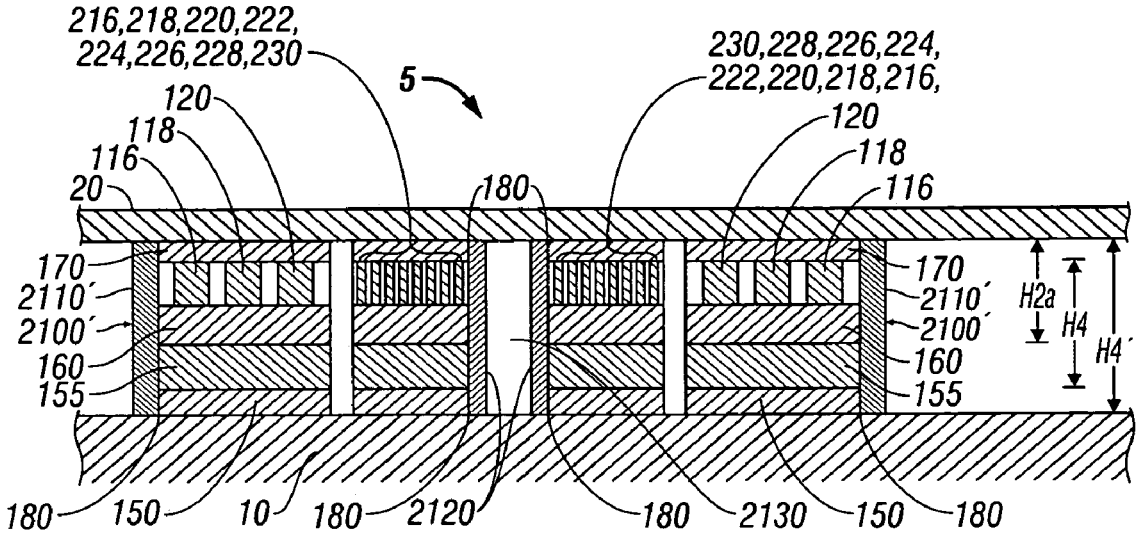
FIG. 3D
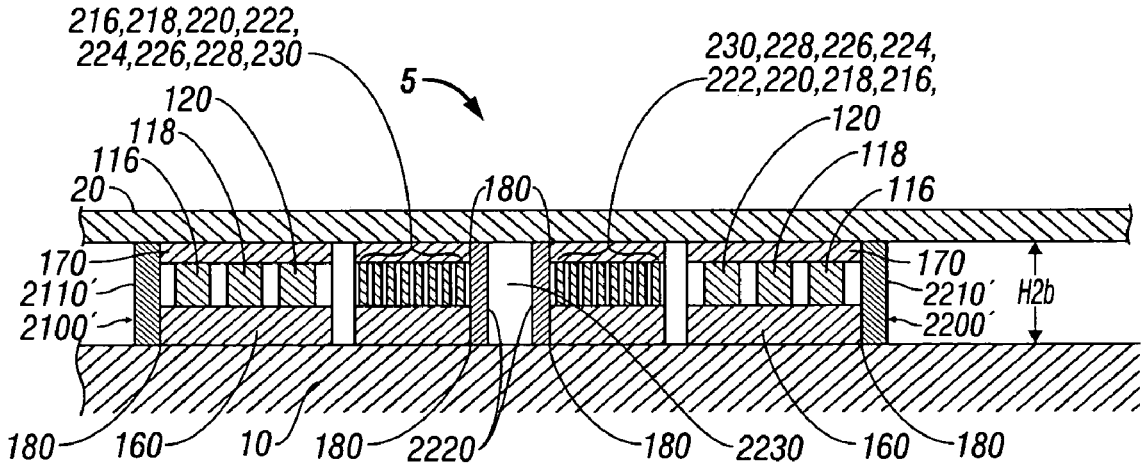
FIG. 3D´

THIN-FILM EAS AND RFID ANTENNAS

BACKGROUND

1. Field of the Disclosure

The present disclosure relates to antenna assemblies for electronic article surveillance (EAS) or radiofrequency identification (RFID) which are made of thin films and/or thin film materials.

2. Background of Related Art

Electronic article surveillance (EAS) systems project a electromagnetic field into an interrogation zone usually at the exit of a retail store. The electromagnetic field excites a marker that returns a signal to the EAS system which alarms to indicate the presence of an EAS marker within the interrogation zone. EAS markers may be placed on merchandise to prevent unauthorized removal of tagged merchandise from a retail establishment, while EAS system transmitter antennas are used to project the electromagnetic field into the interrogation zone. EAS system receiver antennas are used to detect the returned signal from the EAS marker. EAS system transceiver antennas are constructed to perform both transmit and receive functions. By proper design and configuration of the EAS antennas, the system may provide an electromagnetic field of sufficient intensity to adequately excite the EAS marker and provide adequate receive sensitivity so that the return signal received by the EAS system may be detected above the electromagnetic noise in the retail environment.

Properly designed EAS system antennas provide electromagnetic fields that provide the following characteristics:

- cover the entire interrogation zone with sufficient intensity field to excite an EAS marker;
- have adequate intensity in all spatial orientations throughout the interrogation zone;
- do not extend beyond the interrogation zone at high intensities that would cause tagged merchandise outside the interrogation zone to alarm the system; and
- comply with regulatory requirements for electromagnetic field emissions.

In addition, because the interrogation zone is often located in locations where retailers desire to display merchandise for sale, typical EAS antenna systems are either concealed or small and streamlined so that the system installation meets the retailer's aesthetic requirements.

In addition, the system also needs to be designed so that the transmitter(s) and the antenna(s) meet the various regulatory or safety agency requirements.

Traditional EAS systems have relied on antennas that are placed in pedestals positioned on opposite sides of an entrance. The antennas project the magnetic field across the opening. However, there is a practical limit as to how wide of an opening may be covered by an EAS system due to limitations in the size of the antennas and the regulatory or safety limitations on the intensity of the electromagnetic field strength.

As a result, the use of pedestals is often impractical to provide an interrogation zone to cover very large openings such as those at mall entrances or exits due to the challenges in meeting the above listed requirements.

In order to adequately cover a wide area such as a mall entrance or exit, an array of several wire loop antennas may be buried in the concrete under the flooring. Such loop antennas are designed as transceivers and project magnetic fields into the region above the floor to detect the returned signal from the EAS marker. Typically these types of antennas are capable of covering an interrogation zone extending up to about 1.2 meters above the floor. Such an antenna also has the advantage of being modular so that it may be extended to cover various width openings. One such system is marketed by Sensormatic Electronics (Boca Raton, Fla., USA) under the brand name "Floormax".

Typically, this type of design has the following installation characteristics:

- The antenna coils are mounted in the floor and require significant excavation of the sub-floor for installation;
- After installation the antennas are encased in concrete that is re-poured over and around the antennas making them inaccessible without further excavation.

In installations where no metal is present the antennas may be mounted over the sub-floor without excavation. But, due to the thickness of the antenna coil, when antennas are mounted above the sub-floor, layers of additional concrete must be floated onto the surface of the sub-floor to form a gradual slope to cover the antenna. This gradually sloped region may extend several feet on all sides of the antenna. This concrete work is often expensive and may be impractical in some cases.

U.S. Patent Application Publication No. US 2004/0135690 A1, entitled "WIDE EXIT ELECTRONIC ARTICLE SURVEILLANCE ANTENNA SYSTEM" by Copeland. et. al., published on Jul. 15, 2004, and U.S. Patent Application Publication No. US 2004/0217866 A1, also entitled "WIDE EXIT ELECTRONIC ARTICLE SURVEILLANCE ANTENNA SYSTEM" by Copeland et al., published Nov. 4, 2004, both being incorporated by reference herein in their entirety, describe several different systems to cover wide exits or entrances and use various combinations of the following antenna characteristics:

- overhead/ceiling mounted ferrite core transceiver or transmitter antennas;
- side/wall mounted ferrite core transceiver or transmitter antennas;
- overhead/ceiling mounted wire-loop transceiver or transmitter antennas;
- side/wall mounted wire-loop transceiver or transmitter antennas;
- perimeter wire-loop transceiver or transmitter antennas that extend around the entire perimeter of the interrogation zone;
- side/wall mounted core receiver antennas;
- overhead/ceiling mounted core receiver antennas;
- floor mounted core receiver antennas designed to be mounted in trenches in the sub-floor;
- floor mounted loop receiver antennas also designed to be mounted in small trenches in the sub-floor.

However, systems using receivers in the floor still require cutting trenches in the sub-floor routing of wire-loop or core receiver antennas. This is often undesirable due to the expense and inconvenience to the retailer.

Other efforts have been disclosed using a perimeter wire-loop transceiver or transmitter antenna with added overhead/ceiling mounted or side/wall mounted core receiver antennas to cover the interrogation zone. This solution has been successfully deployed for openings up to 3 meters high and about 5 meters in width. Again, this system also requires cutting trenches in the floor to install wire-loop antenna which is undesirable.

As a result, many known approaches require excavation or trenching of the subfloor to allow installation.

SUMMARY OF THE INVENTION

The embodiments of the present disclosure provide a very thin antenna structure that may be used as a transmitter antenna, a receiver or a transceiver that is thin enough to be mounted under the flooring without any need for cutting or modification of the structure of the subfloor.

More particularly, the present disclosure relates to an antenna assembly particularly suitable for an electronic article surveillance (EAS) and/or a radiofrequency identification (RFID) network. In one embodiment, the antenna assembly is capable of being installed in a structure wherein the structure comprises a covering and a substructure and the antenna assembly is configured with thin film materials to have a total thickness such that the antenna assembly can be disposed between the substructure and the covering. The antenna assembly may have a total thickness not greater than about 15 millimeters (mm).

The antenna assembly may include at least one of (a) a transmitter antenna (b) a transceiver antenna, and (c) a receiver antenna, with the receiver antenna being configured as one of an air core antenna and a non-air core antenna. The antenna assembly may include a base insulating layer, and at least one of the transmitter antenna, the transceiver antenna and the receiver antenna may be at least partially disposed on the base insulating layer. The base insulating layer may include a common planar surface, and at least one of the transmitter antenna, the transceiver antenna and the receiver antenna may be at least partially disposed on the common planar surface of the base insulating layer.

The receiver antenna may be configured as a non-air core receiver antenna and may be substantially disposed in an internal compartment that is over the common planar surface of the base insulating layer or within the base insulating layer. The antenna assembly may further include an enclosure insulating layer. The enclosure insulating layer may be at least partially disposed on the at least one of the transmitter antenna, the transceiver antenna and the receiver antenna. The antenna assembly may further include a support insulating layer, with the base insulating layer being at least partially disposed on the support insulating layer. A filler insulating layer may be at least partially disposed between the base insulating layer and the support insulating layer.

In one embodiment, the transmitter antenna and/or the transceiver antenna and/or the receiver antenna may include at least one antenna trace conductor including a start end conductor layer portion and a finish end conductor layer portion each having a thickness, wherein the finish end conductor layer portion crosses one of over and under the start end conductor layer portion to form an end crossover section of the antenna assembly, and wherein the end crossover section includes the antenna trace conductor and an antenna assembly base insulating layer having a thickness and disposed between the start end conductor layer portion and the finish end conductor layer portion.

In one embodiment, the antenna assembly may be at least partially housed within a housing assembly, with the housing assembly configured with thin film materials such that both the housing assembly and the antenna assembly can be disposed between the substructure and the covering. The housing assembly may include the enclosure insulating layer, the base insulating layer and an outer wall along an outer periphery of the antenna assembly so that the housing assembly at least partially houses the antenna assembly thereby. The housing assembly may further include an inner wall along an inner periphery of the antenna assembly, so that the housing assembly at least partially houses the antenna assembly thereby. The housing assembly may be configured such that the antenna assembly is hermetically sealed. When the antenna assembly is at least partially housed within a housing assembly, the housing assembly may be configured with thin film materials such that both the housing assembly and the antenna assembly can be disposed between the substructure and the covering.

In one embodiment, when the receiver antenna is configured as a non-air core receiver antenna and is substantially disposed in the internal compartment within the base insulating layer, the base insulating layer may have a thickness including a first sub-layer having a thickness, a second sub-layer having a thickness, and a base sub-layer disposed therebetween having a thickness wherein the base sub-layer includes the internal compartment defined therein formed by the first and second sub-layers. The receiver antenna configured as a non-air core receiver antenna may include a wire loop at least partially coiled around at least one bar of magnetic material formed in a thin-film construction.

BRIEF DESCRIPTION OF THE DRAWINGS

The subject matter regarded as the embodiments is particularly pointed out and distinctly claimed in the concluding portion of the specification. The embodiments, however, to organization and method of operation, together with objects, features, and advantages thereof, may best be understood by reference to the following detailed description when read with the accompanying drawings in which:

FIG. 1B' is a cross-sectional elevation view of the area of detail of the transmitter or transceiver assembly at a cross-over region and a variation of the completely illustrated housing assembly taken along line 1B'-1B' of FIG. 1A and as disposed in a floor;

FIG. 1C' is a cross-sectional elevation view of the variation of the completely illustrated housing assembly and transmitter or transceiver assembly taken along line 1C'-1C' of FIG. 1 and as disposed in a floor;

FIG. 2B is a cross-sectional elevation view of the area of detail of the transmitter or transceiver assembly and the housing assembly completely illustrated at a cross-over region taken along section line 2B-2B of FIG. 2 and as disposed in a floor;

FIG. 2B' is a cross-sectional elevation view of the area of detail of the transmitter or transceiver assembly at a crossover region and a variation of the completely illustrated housing assembly taken along line 2B'-2B' of FIG. 2 and as disposed in a floor;

FIG. 2C is a cross-sectional elevation view of the completely illustrated housing assembly and transmitter or transceiver assembly taken along line 2C-2C of FIG. 2 and as disposed in a floor;

FIG. 2C' is a cross-sectional elevation view of the transmitter or transceiver assembly and the variation of the completely illustrated housing assembly taken along line 2C'-2C' of FIG. 2;

FIG. 3C is a cross-sectional elevation view of the area of detail of an end cross-over region of the antenna assembly and housing assembly completely illustrated of FIGS. 3 and 3A taken along section line 3C-3C of FIG. 3A and as disposed in a floor;

FIG. 3C' is a cross-sectional elevation view of an end cross-over region of the antenna assembly and housing assembly completely illustrated of FIGS. 3 and 3A taken along section line 3C-3C of FIG. 3A and as disposed in a floor;

FIG. 3D is a cross-sectional elevation view of the completely illustrated housing assembly and antenna assembly taken along line 3D-3D of FIG. 3 and as disposed in a floor;

FIG. 3D' is a cross-sectional elevation view of the antenna assembly and the variation of the completely illustrated housing assembly taken along line 3D'-3D' of FIG. 3

DETAILED DESCRIPTION

Numerous specific details may be set forth herein to provide a thorough understanding of the embodiments of the invention. It will be understood by those skilled in the art, however, that various embodiments of the invention may be practiced without these specific details. In other instances, well-known methods, procedures, components and circuits have not been described in detail so as not to obscure the various embodiments of the invention. It can be appreciated that the specific structural and functional details disclosed herein are representative and do not necessarily limit the scope of the invention.

It is worthy to note that any reference in the specification to "one embodiment" or "an embodiment" according to the present disclosure means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

The present disclosure relates to a very thin antenna structure that may be used as a transmitter, a receiver or a transceiver that is thin enough to be mounted under the flooring without any need for cutting or modification of the structure of the subfloor. Various embodiments of the antenna assembly are shown that provide for single or multiple transmitter or transceiver loop antennas; single or multiple receiver loop antennas; and separate transmitter and receiver loop antennas.

Figure 1:
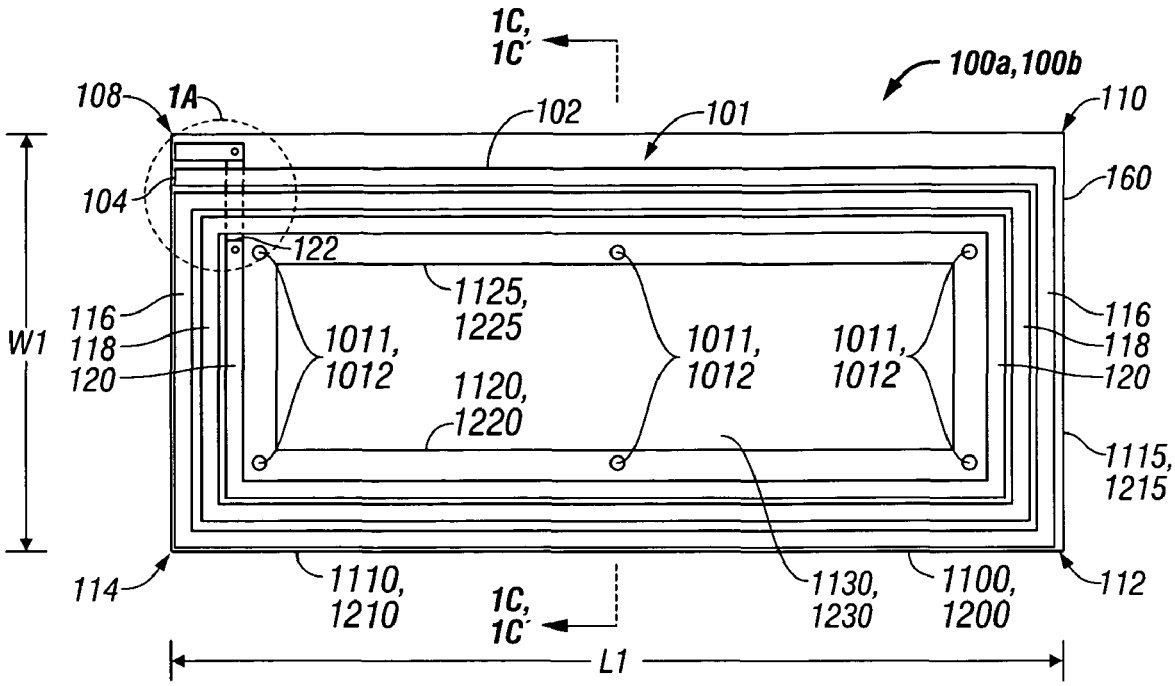
FIG. 1 is a plan view of a single loop air core transmitter or transceiver assembly using thin film construction and partially illustrating a housing assembly housing the transmitter or transceiver assembly according to one embodiment of the present disclosure.
Figure 1A:
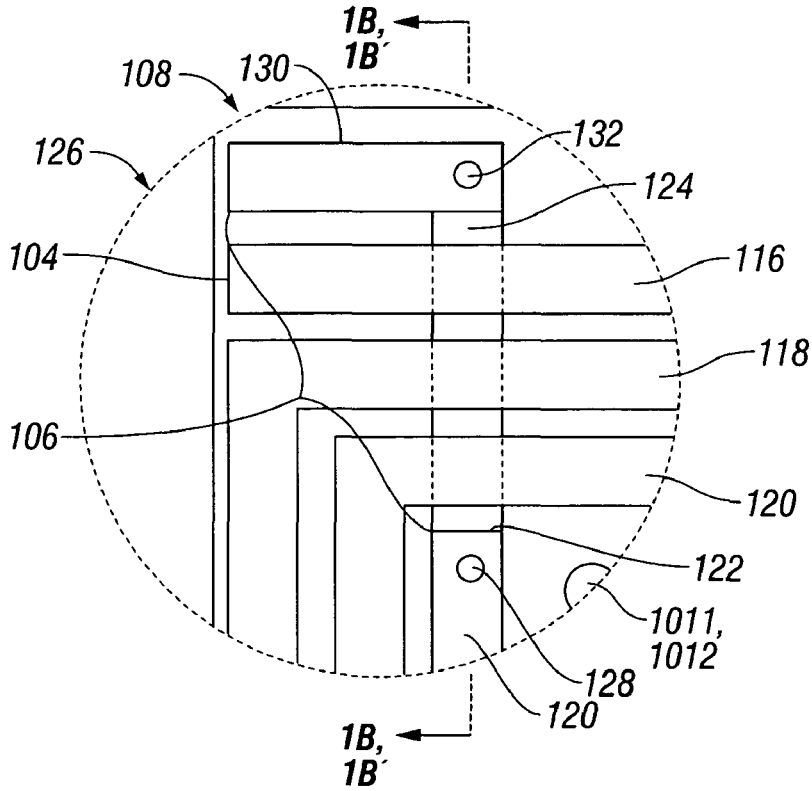
FIG. 1A is a plan view of the area of detail of the transmitter or transceiver assembly and partially illustrated housing assembly of FIG. 1.
Figure 1B:
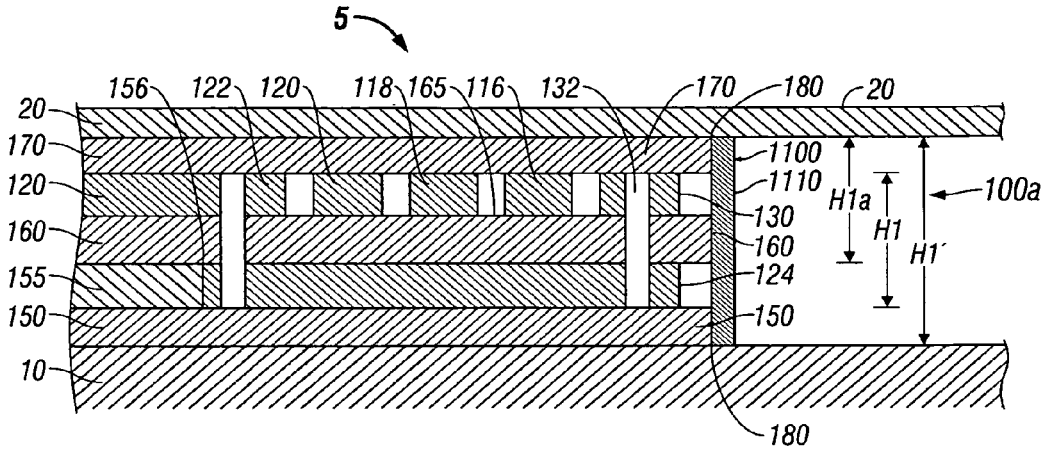
FIG. 1B is a cross-sectional elevation view of the area of detail of the transmitter or transceiver assembly and housing assembly completely illustrated at a cross-over region taken along line 1B-1B of FIG. 1A and as disposed in a floor.
Figure 1B:
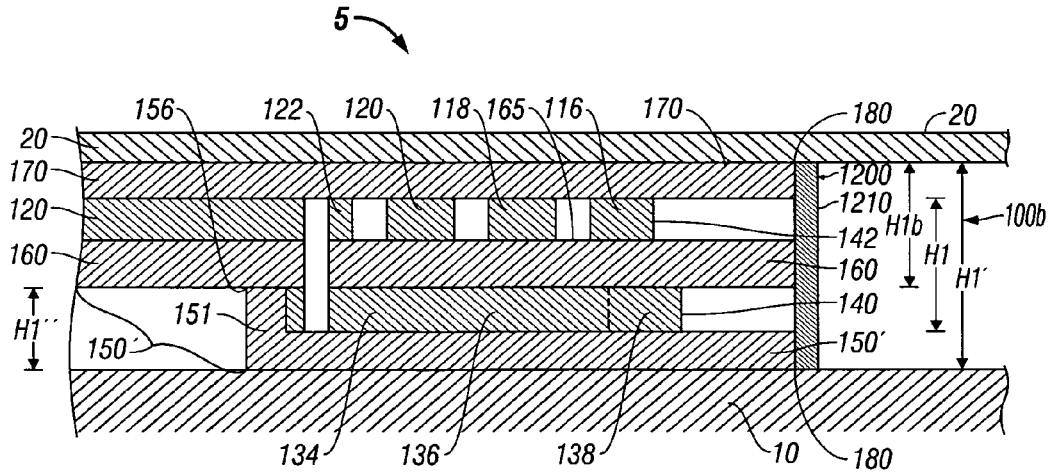
Figure 1C:
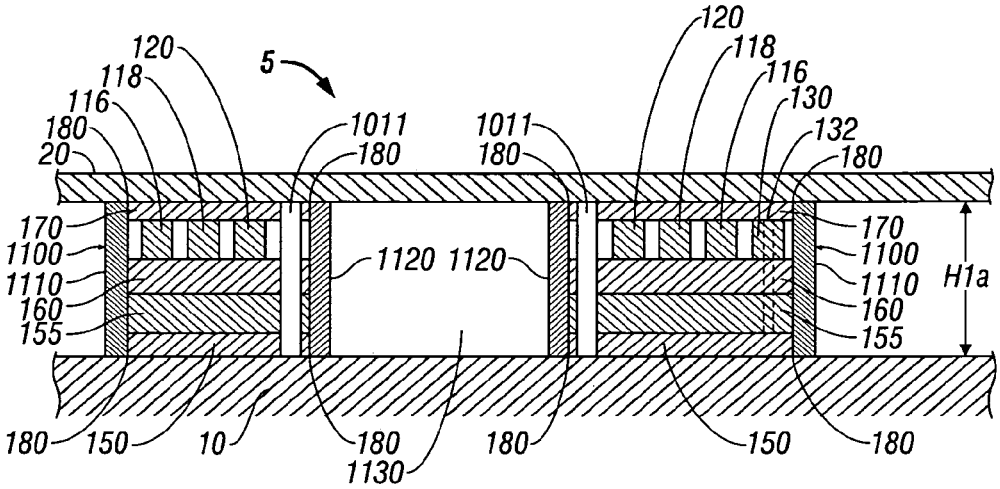
FIG. 1C is a cross-sectional elevation view of the completely illustrated housing assembly and transmitter or transceiver assembly taken along line 1C-1C of FIG. 1 and as disposed in a floor.
Figure 1C:
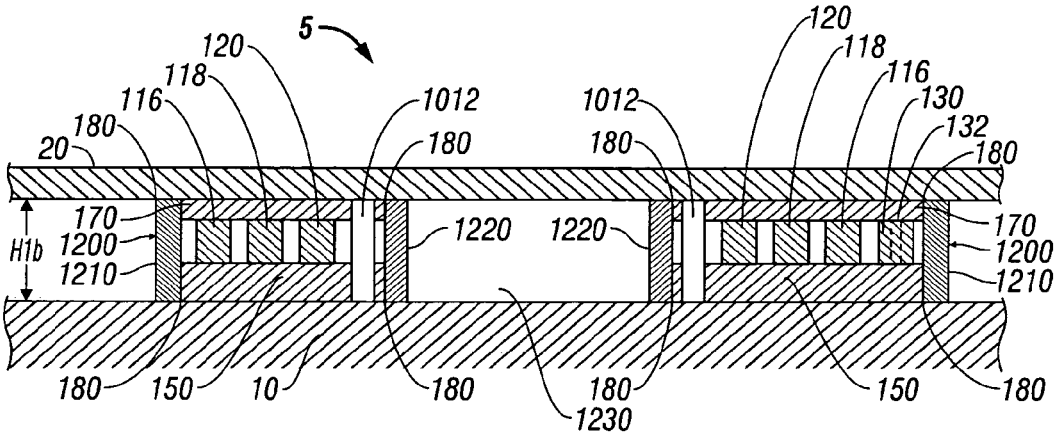

Turning now to the specific embodiments of the present disclosure, FIGS. 1, 1A, 1B and 1C illustrate an embodiment of a single loop transmitter or transceiver assembly using thin film construction that may be used for EAS or RFID systems according to the present disclosure. More particularly, FIG. 1 is a plan view of single loop transmitter or transceiver assembly 100*a* using thin film construction. For purposes of simplification, FIG. 1 only partially illustrates a housing assembly 1100 housing the transmitter or transceiver assembly 100. FIG. 1A is a plan view of the area of detail of the transmitter or transceiver assembly 100*a* and partially illustrated housing assembly 1100 of FIG. 1. FIG. 1B is a cross-sectional elevation view of the area of detail of the transmitter or transceiver assembly 100*a* and housing assembly 1100 completely illustrated at a cross-over region taken along line 1B-1B of FIG. 1A. FIG. 1C is a cross-sectional elevation view of the completely illustrated housing assembly 1100 and transmitter or transceiver assembly 100*a* taken along line 1C-1C of FIG. 1. As described in more detail below, the housing assembly 1100 includes an outer wall 1110 and an inner wall 1120.

Antenna assembly 100*a* includes an antenna 101 at least partially disposed on a common planar surface 165 of antenna assembly base substrate or insulating layer 160. Antenna 101 includes an antenna trace conductor 102 having a start end conductor layer portion 104 and a finish end conductor layer portion 106. The antenna trace conductor 102 may be configured as a rectangular spiral as illustrated in FIGS. 1 and 1A. However, alternate configurations such as square, circular, elliptical, or other such shapes may be employed. The embodiments are not limited in this context. The start end conductor layer portion 104 forms one end of the rectangular spiral while the finish end conductor layer portion 106 forms another end of the rectangular spiral.

As shown in FIG. 1, starting at a first corner region 108 with the start end conductor layer portion 104, the antenna trace conductor 102 proceeds in an inward spiral to second, third and fourth corner regions 110, 112 and 114, respectively, to form a first loop 116. At the first corner region 108, the antenna trace conductor 102 proceeds to form a second loop 118, parallel to first loop 116, in an inward spiral to second, third and fourth corner regions 110, 112 and 114, respectively. Similarly, at the first corner region 108, the antenna trace conductor 102 proceeds to form a third loop 120, parallel to first loop 116 and second loop 118, in an inward spiral to second, third and fourth corner regions 110, 112 and 114, respectively. Those skilled in the art will recognize that a greater or a fewer number of loops 116 to 120 may be employed to configure the antenna 101, and that three loops 116, 118 and 120 are by way of illustration only. Therefore, the antenna 101 is configured to have a multiplicity of loops such as loops 116 to 120. The embodiments are not limited in this context.

Although the loops 116, 118 and 120 are described as spiraling inwardly, the loops 116, 118 and 120 may be described as, or installed on the antenna assembly base insulating layer 160 in a manner so as to effect, an outward spiral as opposed to an inward spiral. The embodiments are not limited in this context.

As best shown in FIGS. 1A and 1B, at the first corner region 108, the third loop 120 terminates at a winding trace termination 122 substantially transverse to the first, second and third parallel loops 116, 118 and 120. At termination position 122, the antenna trace portion 102 interfaces with the finish end conductor layer portion 106. The finish end conductor layer portion 106, via a cross-over member 124, crosses either over or under the start end conductor layer portion 104 to form an end cross-over region 126 at the first corner 108. In one embodiment, the cross-over member 124 is in electrical communication with the antenna trace conductor 102 through a via connection 128 disposed in proximity to the winding trace termination 122. The cross-over member 124 extends either under, as shown in FIGS. 1, 1A and 1B, or over (not shown) the first, second and third parallel loops 116, 118 and 120 to a finish connection 130. The cross-over member 124 is in electrical communication with the finish connection 130 through a via connection 132. As a result, the finish connection 130 is in electrical communication with the antenna trace conductor 102 through the via connections 128 and 132 and the cross-over member 124. In one embodiment, the finish connection 130 is disposed substantially parallel to and adjacent the first loop 116 such that the finish end conductor layer portion 106 forms an L-shape.

As best illustrated in FIG. 1B, the end crossover region 126 includes the antenna trace conductor 102 and the base insulating layer 160 disposed between the start end conductor layer portion 104 and associated loops 116, 118 and 120 and the finish end conductor layer portions 106, and, in particular, the cross-over member 124. Therefore, the start end conductor layer portion 104 and the finish end conductor layer portion 106 are electrically isolated from each other. The end crossover region 126 of the antenna assembly 100*a* may also be configured to be disposed on an antenna assembly support insulating layer 150; More particularly, the crossover member 124 is disposed on the support insulating layer 150. In one embodiment, as specifically illustrated in FIG. 1B, a dummy or filler insulation or insulating layer 155 may be disposed adjacent to the crossover member 124 and between the insulating layer 160 and the support insulating layer 150.

The antenna assembly 100*a* may also include an antenna assembly enclosure or top cover insulating layer 170 at least partially disposed over the antenna assembly 100*a* and over the common planar surface 165. In addition, the antenna assembly 100*a* is configured such that the end cross-over region 126, the antenna trace conductor 102, the support insulating layer 150, the base insulating layer 160, and the enclosure insulating layer 170 are each constructed of a thin film made from a thin film material. In particular, the electrically conductive members which are included in the end cross-over region 126, such as the antenna trace termination 122, the cross-over members 124, the finish connection 130, and the antenna trace conductor 102, may be constructed of a thin film of conductive printing, copper tape, or other suitable electrically conductive material capable of being applied in a thin film layer. The thin film material of the electrically insulating members such as first, second and third insulating layers 150, 160 and 170 may be selected from the group consisting of polyvinylidene fluoride (PVDF), sold under the trade name Kynar® by Elf Atochem North America, Inc. of Philadelphia, Pa., USA or Solef® by Solvay America, Inc. of Houston, Tex., USA, or a polyester film, sold under the trade name Mylar® by E.I. du Pont de Nemours and Company, Wilmington, Del., USA, either of which is capable of being applied in a thin film layer. The foregoing materials are specified by way or example only and those skilled in the art will recognize that other suitable materials may be employed.

As a result of construction using the thin film material, a total maximum height H1 is defined by the thickness of the cross-over member 124, the base insulating layer 160 over the cross-over member 124, and the first, second and third parallel loops 116, 118 and 120 and the finish connection 130 over the base insulating layer 160. The total maximum height H1 ranges up to 0.7 millimeters (mm).

In one embodiment, when the antenna assembly 100*a* further includes the support or bottom insulating layer 150 and the enclosure insulating layer or top cover 170, a total maximum height H1' is defined by the thickness of the support or bottom insulating layer 150, the cross-over member 124 over the support insulating layer 150, the base insulating layer 160 over the cross-over member 124, the first, second and third parallel loops 116, 118 and 120 and the finish connection 130 over the base insulating layer 160, and the enclosure insulating layer or top cover 170 over the first, second and third parallel loops 116, 118 and 120 and the finish connection 130.

As illustrated in FIG. 1B, a structure such as a floor 5 of an edifice or establishment (not explicitly shown) includes a substructure or subfloor 10 and a covering such as a flooring or floor covering 20. Those skilled in the art will recognize that and understand how the structure may also be a wall or ceiling or other portion, either indoors or outdoors, of the edifice or establishment. Similarly, the substructure may be a wall interior, ceiling interior or the like. The covering may be a wall board or ceiling surface or the like. The embodiments are not limited in this context. However, for the purposes of illustration throughout the present disclosure, the structure is referred to as floor 5 of an edifice or establishment, the substructure is referred to as subfloor 10, and the covering is referred to as flooring or floor covering 20.

The antenna assembly 100*a* is configured with the thin film materials, which include the electrically conductive end cross-over region 126, such as the antenna trace termination 122, the cross-over members 124, the finish connection 130, and the antenna trace conductor 102, and the electrically insulating layers 150, 160 and 170, to have a total thickness, as represented by the total maximum height H1', such that the antenna assembly 100*a* may be disposed between the subfloor 10 and the flooring or floor covering 20, without significantly altering the structural features of the floor or causing a deleterious effect to pedestrians or pedestrian traffic on the floor. The total maximum height H1' ranges up to about 15 mm, although in most applications, the total maximum height H1' ranges up to about 1.3 mm. Length L1 and width W1 of the antenna assembly 100*a* may be in the range of about 65 cm by about 155 cm, respectively, although the embodiments are not limited in this context.

In one embodiment, the antenna assembly 100*a* may be configured such that when the support insulating layer 150 and/or the enclosure insulating layer or top cover 170 is omitted, the total maximum height H1 equals the total maximum height H1' when the support insulating layer 150 and/or enclosure insulating layer or top cover 170 are included. More particularly, the support or bottom insulating layer 150 may be omitted when the subfloor 10 itself provides an adequate electrically insulating effect. However, to protect the antenna assembly 100*a* from environmental conditions such as moisture fluctuations, the antenna assembly 100*a* may be housed at least partially, if not entirely, within the housing assembly 1100. As illustrated in FIGS. 1, 1B and 1C, base insulating layer 160 may be at least partially disposed on the support insulating layer 150. A dummy or filler insulation or insulating layer 155 may be at least partially disposed between the base insulating layer 160 and the support insulating layer 150. The housing assembly 1100 includes an outer wall 1110 extending around an outer periphery 1115 of the antenna assembly 100. The outer wall is joined to the enclosure insulating layer 170 and may be joined to the base insulating layer 160 to at least partially enclose and house the antenna assembly 100*a*. The housing assembly 1100 may include an inner wall 1120 extending around an inner periphery 1125 of the antenna assembly 100. The inner wall 1120 encloses a region 1130 which may be empty space or may contain holes for permeation of tile adhesive as explained below. The inner periphery 1125 and portions adjacent thereto may be formed of a solid material.

In one embodiment, as illustrated in FIGS. 1B and 1C, the housing assembly 1100 may include by incorporation the support insulating layer 150 as a lower lid and enclosure insulating layer 170 as an upper lid of the housing assembly 1100. The outer and inner walls 1110 and 1120, respectively, may be joined at least partially, if not entirely, to the support insulating layer 150 and to the enclosure insulating layer 170 at joints 180 to form a hermetic seal. The housing assembly 1100 further includes a series of mounting sleeves or rings 1011 that are positioned as required in the portions of the housing assembly 1100 adjacent to the inner periphery 1125. Six mounting sleeves or rings 1011 by way of example are illustrated in FIG. 1, one each in the vicinity of the four corners formed by the region 1130 and the inner periphery 1125 of the of the inner walls 1120, and one each midway in the lengthwise direction of housing assembly 1100 on either side of the inner periphery 1125.

With the flooring 5 removed, the sub-floor 10 is cleaned. The housing assembly 1100 containing the antenna assembly 100*a* is laid out on the sub-floor 10 at the location desired. Anchor holes (not shown) are drilled in the sub-floor 10 to accommodate mounting screws (not shown) corresponding to the series of mounting sleeves or rings 1011. Once the housing assembly 1100 is mounted in the desired location using the mounting screws, a tile adhesive may be placed in the open region 1130 which may be empty space or may contain holes for permeation of the tile adhesive.

Referring now to FIGS. 1, 1A, 1B' and 1C', in a variation of the embodiment of the housing assembly 1100, an antenna assembly 100*b* may be incorporated into a housing assembly 1200. The housing assembly 1200 and antenna assembly 100*b* are identical to housing assembly 1100 and antenna assembly 100*a*, respectively, except that, as illustrated in FIG. 1B', at the cross-over region 126, the support insulating layer 150' on which the cross-over member 124 is disposed and merges by the upward bend 151 with the base insulating layer 160 to form the corner region or joint 156. The dummy or filler insulation 155 is now omitted throughout the antenna assembly 100' except for the cross-over region 126.

Referring also to FIG. 1C', the housing assembly 1200 now includes an outer wall 1210 extending around an outer periphery 1215 of the antenna assembly 100'. The housing assembly 1200 may include an inner wall 1220 extending around an inner periphery 1225 of the antenna assembly 100'. The outer and inner walls 1210 and 1220, respectively, may be joined at joints 180 to the enclosure insulating layer 170 and to the base insulating layer 150 to at least partially enclose and house the antenna assembly 100*b* thereby. The inner wall 1220 now encloses a region 1230 which may be empty space or may contain holes for permeation of tile adhesive as previously explained above. The inner periphery 1225 and portions adjacent thereto may be formed of a solid material. In a manner analogous to mounting sleeves or rings 1011 of housing assembly 1100, the housing assembly 1200 further includes a series of mounting sleeves or rings 1012 that are positioned as required in the portions of the housing assembly 1200 adjacent to the inner periphery 1225.

By comparing the housing assembly 1100 and antenna assembly 100*a* illustrated in FIG. 1C to the housing assembly 1200 and antenna assembly 100*b* illustrated in FIG. 1C, it is evident that for the same thicknesses of the materials being incorporated, height H1*a* of the outer wall 1110 and inner wall 1120 of housing assembly 1100 is greater than height H1*b* of the outer wall 1210 and inner wall 1220 of housing assembly 1200. Therefore, the housing assembly 1200 provides a lower profile, except at the crossover region 126, as compared to the housing assembly 1100.

Figure 2:
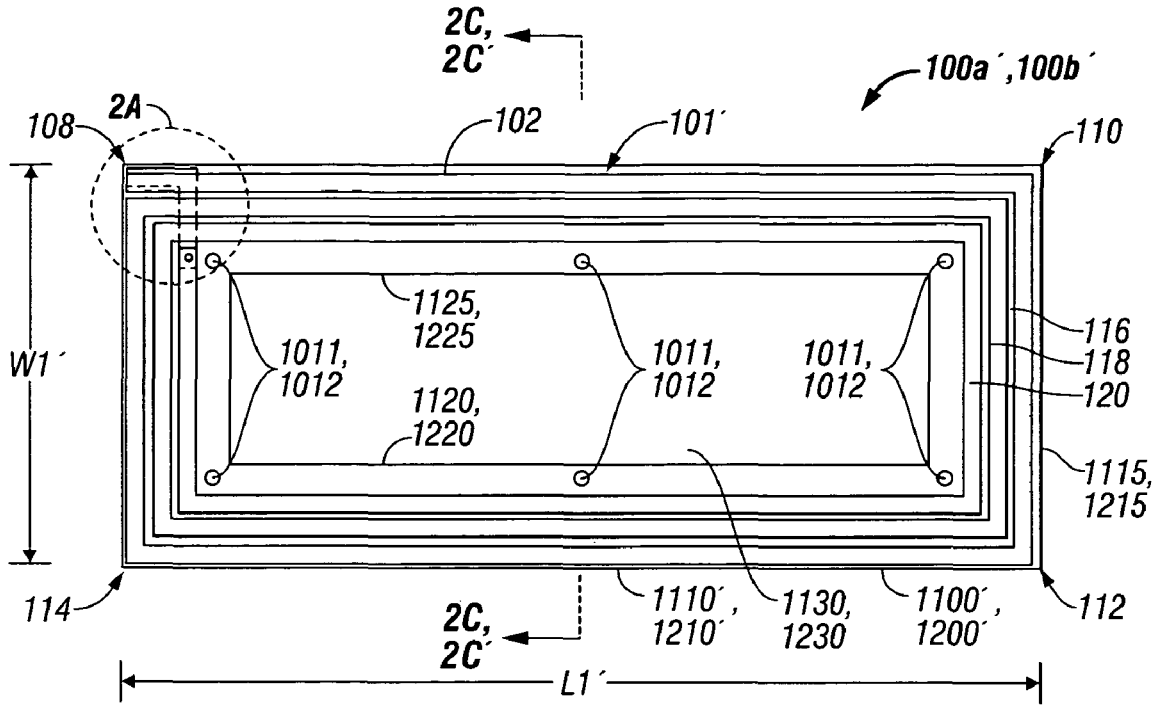
FIG. 2 is a plan view of an alternate embodiment of a single air core transmitter or transceiver loop winding antenna assembly using thin film construction methods and partially illustrating a housing assembly housing the antenna assembly according to the present disclosure.
Figure 2A:
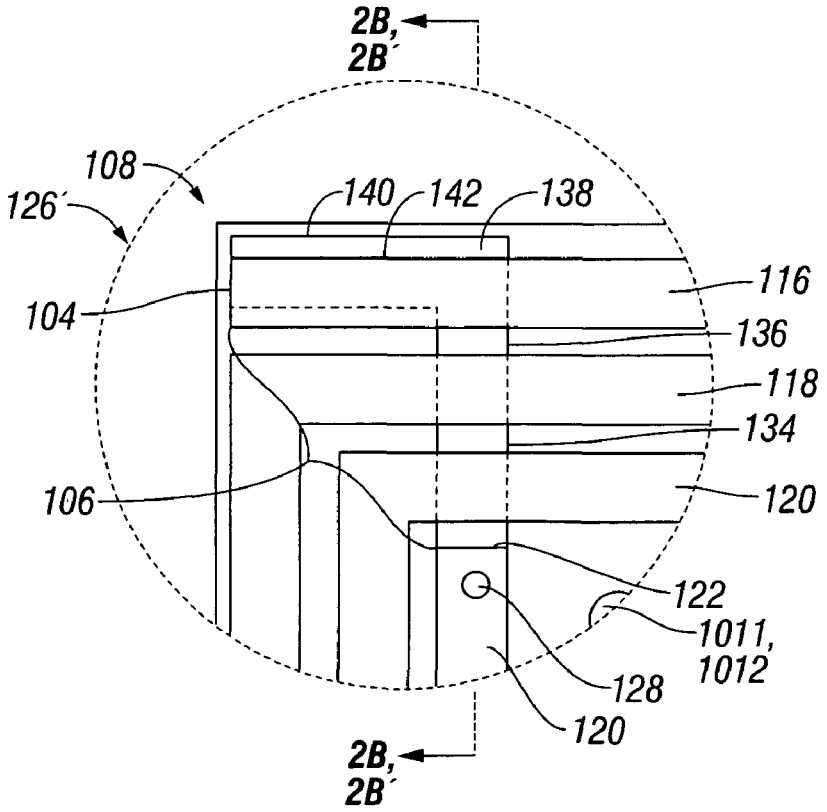
FIG. 2A is a plan view of the area of detail of the single transmitter or transceiver loop assembly and partially illustrated housing assembly of FIG. 2.

FIGS. 2, 2A, 2B and 2C illustrate an alternate embodiment of a single loop transmitter or transceiver assembly for EAS or RFID using thin film construction according to the present disclosure. More particularly, FIG. 2 illustrates an alternate embodiment of the single transmitter or transceiver loop winding antenna assembly 100*a* or 100*b* using thin film construction methods. Again, for purposes of simplification, FIG. 2 only partially illustrates a housing assembly 1100' housing air core antenna assembly 100*a*' or 100*b*'. FIG. 2A is a plan view of the area of detail of the single transmitter or transceiver loop assembly 100*a*' or 100*b*' and partially illustrated housing assembly of FIG. 2. FIG. 2B is a cross-sectional elevation view of the area of detail of the transmitter or transceiver assembly 100*a* and the housing assembly 1100' completely illustrated at a cross-over region taken along section line 2B-2B of FIG. 2. FIG. 2C is a cross-sectional elevation view of the completely illustrated housing assembly 1100' and transmitter or transceiver assembly 100*a*' taken along line 2C-2C of FIG. 2. Again, as described in more detail below, the housing assembly 1100' includes an outer wall 1110' and inner wall 1120.

More particularly, antenna assembly 100*a*' includes an antenna 101' at least partially disposed on the common planar surface 165 of substrate or base insulating layer 160. Antenna 101' includes the antenna trace conductor 102 having start end conductor layer portion 104 and a finish end conductor layer portion 106'.

Antenna 101' is identical to antenna 101, the difference being that the finish end conductor layer portion 106' in first corner 108 has an L-shaped combination cross-over member and finish connection 134 which is in electrical communication with the antenna trace 102 through the via connection 128 which is disposed in proximity to the winding trace termination 122. The L-shape of the combination cross-over member and finish connection 134 is formed by a first branch 136 and a second branch 138 disposed transversely to one another to form an L-shape.

As best shown in FIGS. 2A and 2B, the combination cross-over member and finish connection 134 crosses either under, or over (not shown), the start end conductor layer portion 104 to form an end cross-over region 126' at the first corner 108. More particularly, the first branch 136 crosses under the third loop 120 and the second loop 118 and only a portion of the first loop 116. The second branch 138 is partially disposed under the start end conductor layer portion 104 such that a lateral edge 140 of the second branch 138 extends past a lateral edge 142 of the first loop 116. The antenna 101' is configured to have a multiplicity of loops such as loops 116 to 120.

The end crossover region 126' includes the antenna trace conductor 102 and the base insulating layer 160 disposed between the start end conductor layer portion 104 and associated loops 116, 118 and 120 and the finish end conductor layer portion 106', and, in particular, the combination cross-over member and finish connection 134. Therefore, the start end conductor layer portion 104 and the finish end conductor layer portion 106' are electrically isolated from each other.

Those skilled in the art will recognize that, and understand how, in that the antenna assembly 100 as previously discussed with respect to FIGS. 1, 1A and 1B, and the antenna assembly 100' are operated by alternating current, the designation of end conductor layer portion 104 as the start end conductor layer portion and the designation of end conductor layer portion 106 and end conductor layer portion 106' as the finish end conductor layer portion are chosen arbitrarily for convenience of description only and that end conductor layer portion 104 may also be described as the finish end conductor layer portion and end conductor layer portion 106 and 106' may also be described as the start end conductor layer portion.

As illustrated in FIG. 2B, the antenna assembly 100' may also include the top cover or enclosure insulating layer 170. In addition, the antenna assembly 100' is configured such that the electrically conductive members included in the end cross-over region 126', and the antenna trace conductor 102, and the electrically insulating members such as substrate or support insulating layer 150, the base insulating layer 160, and the top cover or enclosure insulating layer 170 are each constructed of a thin film made from a thin film material, as discussed previously. The end cross-over region 126' may be formed of the same materials as previously described for end cross-over region 126.

As a result of construction using the thin film material, a total maximum height H2 is defined by the thickness of the combination cross-over member and finish connection 134, the base insulating layer 160 over the combination cross-over member and finish connection 134, and the first, second and third parallel loops 116, 118 and 120 over the base insulating layer 160. The total maximum height H2 ranges up to about 0.7 mm.

In one embodiment, when the electrode assembly 100' further includes the support or bottom insulating layer 150 and the enclosure insulating layer or top cover 170, a total maximum height H2' is defined by the thickness of the support or bottom insulating layer 150, the combination cross-over member and finish connection 134 over the support insulating layer 150, the base insulating layer 160 over the combination cross-over member and finish connection 134, the first, second and third parallel loops 116, 118 and 120 over the base insulating layer 160, and the enclosure insulating layer or top cover 170 over the first, second and third parallel loops 116, 118 and 120. The total maximum height H2' ranges up to about 1.3 mm although dimensions as large as about 15 mm are possible.

In one embodiment, the antenna assembly 100' may be configured such that when the support or bottom insulating layer 150 and/or the enclosure insulating layer or top cover 170 are/is omitted, the total maximum height H2 equals the total maximum height H2' when the support or bottom insulating layer 150 and/or the enclosure insulating layer or top cover 170 are/is included.

Again, to protect the antenna assembly 100*a*' from environmental conditions such as moisture fluctuations, the antenna assembly 100*a*' may be housed at least partially, if not entirely, within the housing assembly 1100'. As illustrated in FIGS. 2, 2B and 2C, base insulating layer 160 may be at least partially disposed on the support insulating layer 150. The dummy or filler insulation or insulating layer 155 may be at least partially disposed between the base insulating layer 160 and the support insulating layer 150. The housing assembly 1100' includes an outer wall 1110' extending around an outer periphery 1115' of the antenna assembly 100*a*'. The outer wall 1110' may again be joined to the enclosure insulating layer 170 and may be joined to the base insulating layer 160. The housing assembly 1100' may include the inner wall 1120 extending around the inner periphery 1125 of the antenna assembly 100*a*'. The inner wall 1120 encloses the region 1130 which again may be empty space or may contain holes for permeation of tile adhesive as explained previously. The inner periphery 1125 and portions adjacent thereto may be formed of a solid material.

In one embodiment, as illustrated in FIGS. 2B and 2C, again the housing 1100' may include by incorporation the support insulating layer 150 as a lower lid and enclosure insulating layer 170 as an upper lid of the housing assembly 1100'. The outer and inner walls 1110' and 1120, respectively, may be joined to the support insulating layer 150 and to the enclosure insulating layer 170 at joints 180 to form a hermetic seal. The housing assembly 1100' further includes the series of mounting sleeves 1011 that are positioned as required in the portions of the housing assembly 1100' adjacent to the inner periphery 1125. Again, six mounting sleeves 1011 by way of example are illustrated in FIG. 2, one each in the vicinity of the four corners formed by the region 1130 and the inner periphery 1125 of the of the inner walls 1120, and one each midway in the lengthwise direction of housing assembly 1100' on either side of the inner periphery 1125. The housing assembly 1100' differs from housing assembly 1100 described above with respect to FIGS. 1, 1A, 1B and 1C, in that, referring to FIG. 1, due to the configuration of the cross-over region 126 in the corner region 108, housing assembly 1100 has a width W1 whereas, referring to FIG. 2, due to the configuration of the crossover region 126' in the corner region 108, housing assembly 1100' has a width W1'. The width W1 is governed primarily by the position of the finish connection 130 (see FIGS. 1A and 1B), as compared to width W1' which is governed primarily by the overlapping of the loop winding 116 over the combination cross-over member and finish connection 134, and in particular, the second branch 138 and the lateral edge 140 thereof (see FIGS. 2A and 2B).

Furthermore, in a similar manner as previously described with respect to housing assembly 1100 and antenna assembly 100*a* and housing assembly 1200 and antenna assembly 100*b*, the structure or floor 5 of an edifice or establishment (not explicitly shown) includes substructure or subfloor 10 and a covering such as flooring or floor covering 20. The antenna assembly 100*a*', which includes the electrically conductive end cross-over region 126', is configured with thin film materials as applied to the combination cross-over member and finish connection 134 with respective first and second branches 136 and 138, respectively, first, second and third parallel loops 116, 118 and 120, respectively, and the electrically insulating layers 150, 160 and 170, to have a total thickness, as represented by the total maximum height 12', such that the antenna assembly 100 may be disposed between the subfloor 10 and the flooring or floor covering 20, without significantly altering the structural features of the floor or causing a deleterious effect to pedestrians or pedestrian traffic on the floor. The total maximum height H2' ranges up to about 15 mm, although in most applications, the total maximum height H2' ranges up to about 1.3 mm. The length L1' and width W1' of the antenna assembly 100' again may be in the range of about 155 cm by about 65 cm, respectively, although the embodiments are not limited in this context.

Referring now to FIGS. 2, 2A, 2B' and 2C', in a variation of the embodiment of the housing assembly 1100', antenna assembly 100*b*' may be incorporated into housing assembly 1200'. In a similar manner as previously described, the antenna assembly 100*b*' is identical to antenna assembly 100*a*' except that, as illustrated in FIG. 2B', at the cross-over region 126', support insulating layer 150' on which the cross-over member 124 is disposed and merges by the upward bend 151 with the base insulating layer 160 to form the corner region or joint 156. Again, the dummy or filler insulation 155 is now omitted throughout the antenna assembly 100' except for the cross-over region 126'.

Referring also to FIG. 2C', the housing assembly 1200' now includes an outer wall 1210' extending around an outer periphery 1215' of the antenna assembly 100*b*'. The housing assembly 1200' may include the inner wall 1220 extending around the inner periphery 1225 of the antenna assembly 100*b*'. The inner wall 1220 again encloses region 1230 which may be empty space or may contain holes for permeation of tile adhesive as previously explained above Again, the inner periphery 1225 and portions adjacent thereto may be formed of a solid material. In a manner analogous to mounting sleeves 1011 of housing assembly 1100', the housing assembly 1200 further includes a series of mounting sleeves 1012 that are positioned as required in the portions of the housing assembly 1200' adjacent to the inner periphery 1225.

By similarly comparing the housing assembly 1100' and antenna assembly 100*a*' illustrated in FIG. 2C to the housing assembly 1200' and antenna assembly 100*b*' illustrated in FIG. 2C', it is evident that for the same thicknesses of the materials being incorporated, height H2*a* of the outer wall 1110' and inner wall 1120 of housing assembly 1100' is greater than height H2*b* of the outer wall 1210' and inner wall 1220 of housing assembly 1200'. Therefore, the housing assembly 1200' also provides a lower profile, except at the crossover region 126, as compared to the housing assembly 1100'.

Figure 3:
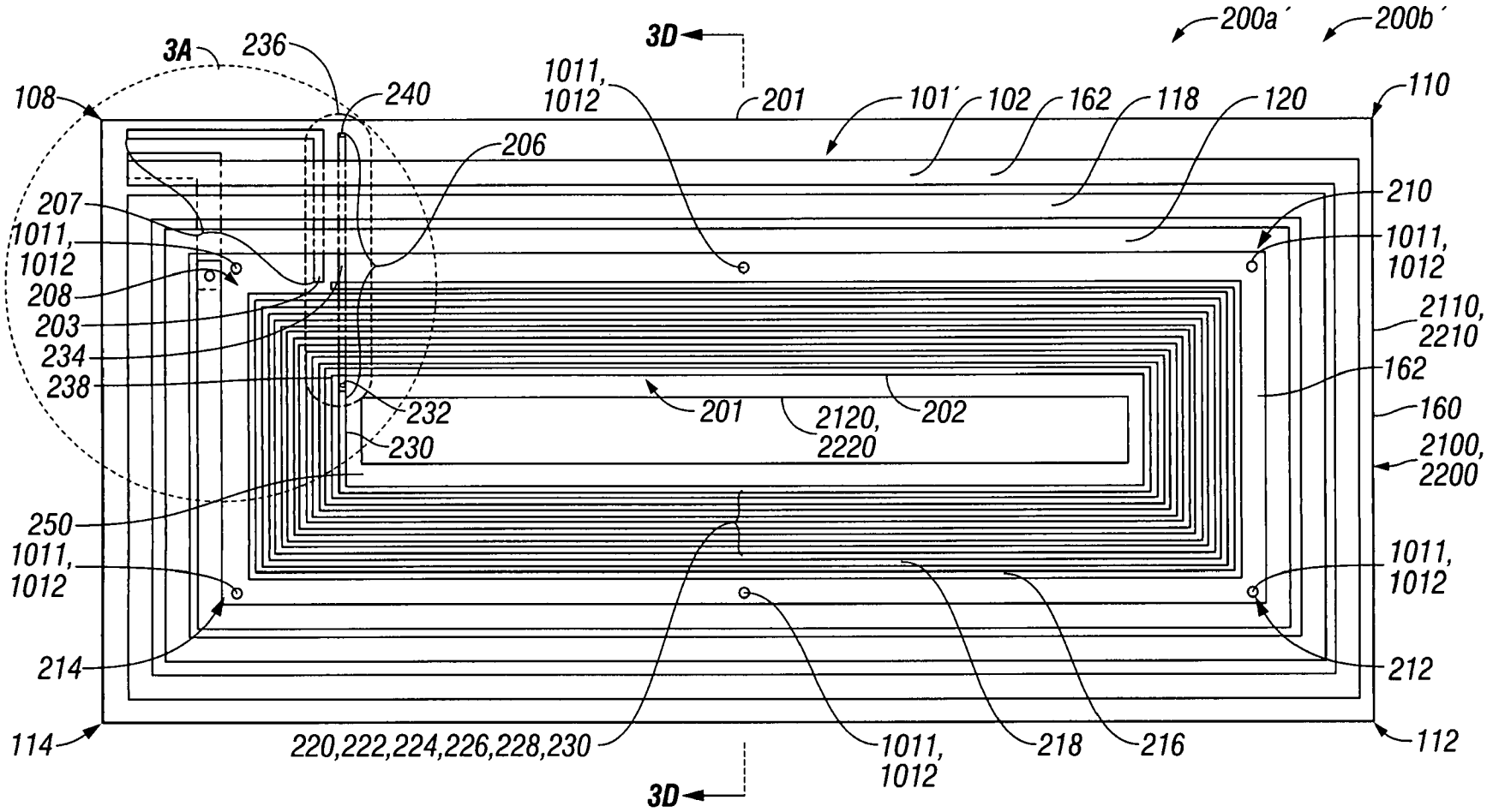
FIG. 3 illustrates one embodiment of an antenna assembly showing separate air core transmitter and receiver windings using thin film construction and partially illustrating a housing assembly housing the antenna assembly according to the present disclosure.
Figure 3A:
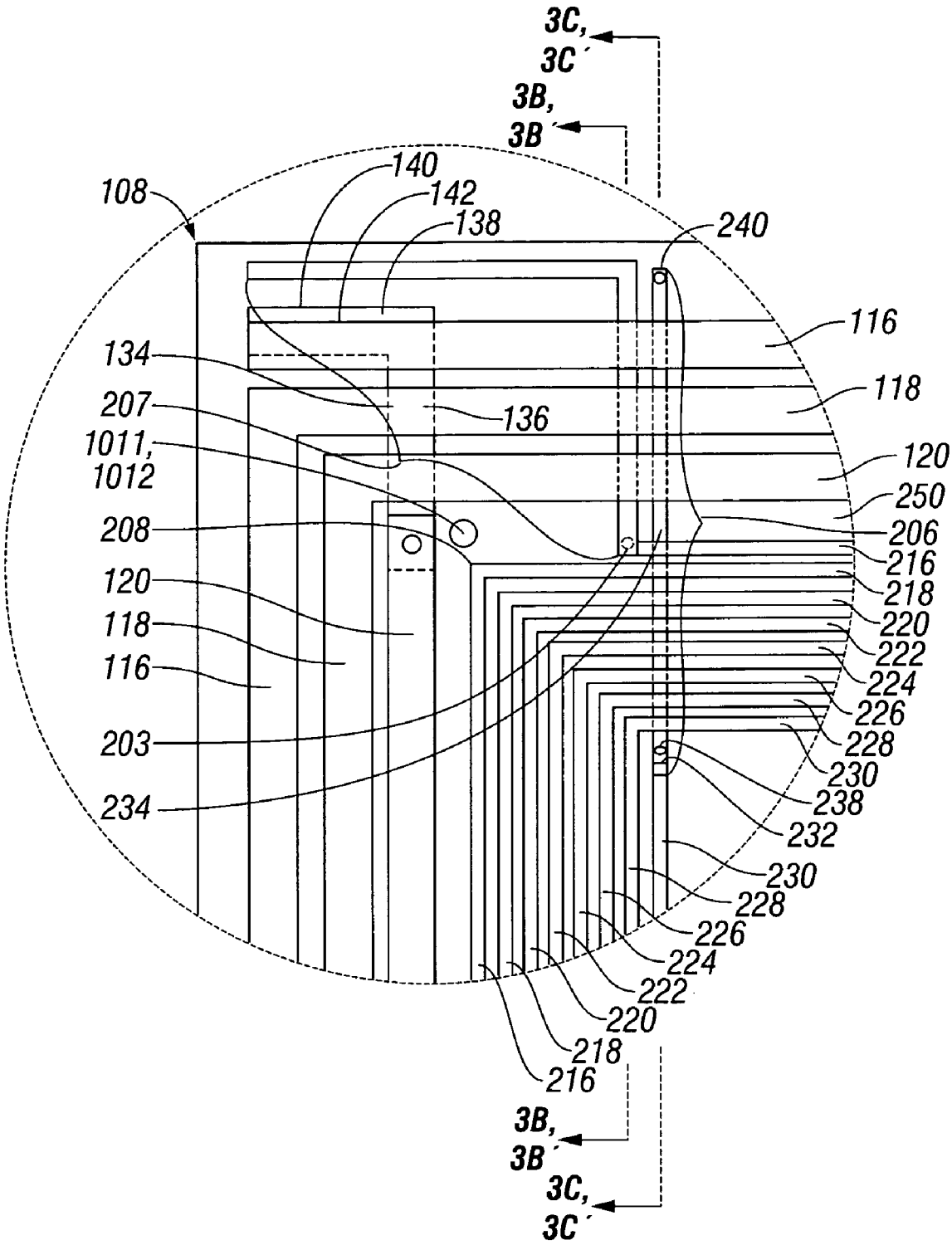
FIG. 3A is a plan view of the area of detail of the antenna assembly showing separate transmitter and receiver windings and of the partially illustrated housing assembly of FIG. 3.
Figure 3B:
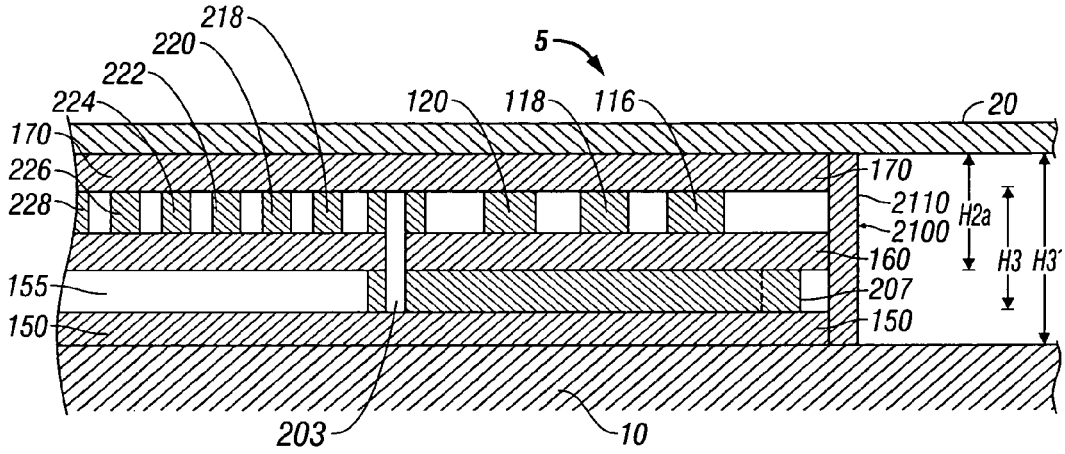
FIG. 3B is a cross-sectional elevation view of the area of detail of an end cross-over region of the housing assembly completely illustrated and antenna assembly of FIGS. 3 and 3A taken along section line 3B-3B of FIG. 3A and as disposed in a floor.
Figure 3B:
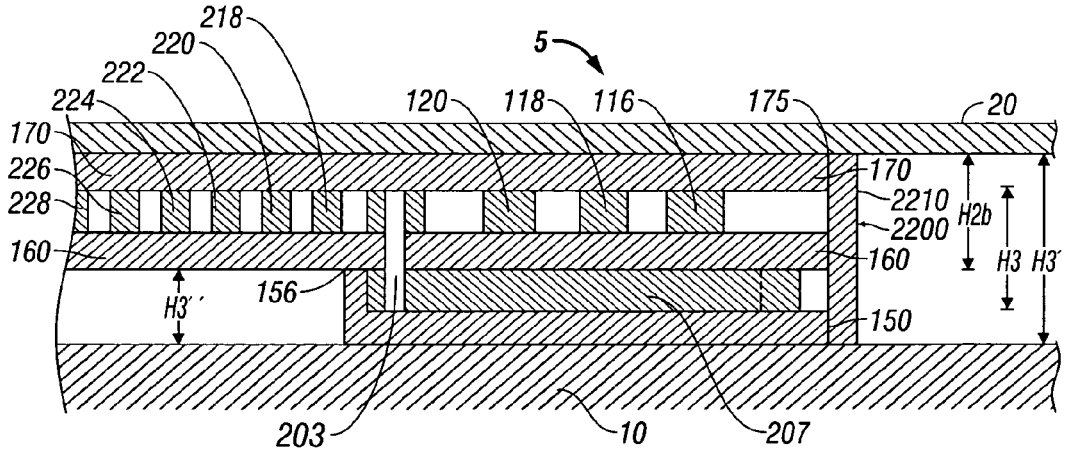

FIGS. 3, 3A, 3B, 3C and 3D, and also FIGS. 3B', 3C' and 3D' illustrate an alternate embodiment of an air core antenna assembly 200*a* or 200*b* which includes separate transmitter and receiver windings according to the present disclosure. Again, for purposes of simplification, FIG. 3 only partially illustrates a housing assembly 2100 or 2200 housing antenna assembly 200*a* or 200*b*, respectively. More particularly, antenna assembly 200*a* or 200*b* includes the antenna 101' (see FIG. 2) at least partially disposed on the common planar surface 165 of substrate or base insulating layer 160 at an interior portion 162. Antenna 101' includes the antenna trace conductor 102 having start end conductor layer portion 104 and finish end conductor layer portion 106'.

Antenna assembly 200*a* or 200*b* is identical to antenna assembly 100*a*' or 100*b*', respectively, except that antenna assembly 200*a* or 200*b* further includes a separate receiver antenna 201 which also may be at least partially disposed on or over the base insulating layer 160, and in particular on or over the common planar surface 165. Receiver antenna 201 includes an antenna trace conductor 202 having a finish end conductor layer portion 207 and a start end conductor layer portion 206. At a receiver cross-over region 236, the finish end conductor layer portion 207 is positioned to cross either under or over (not shown) the first, second and third loops 116, 118 and 120, respectively, of transmitter antenna trace 102 to a first corner position 208 of the antenna trace conductor 202. In one embodiment, the finish end conductor layer portion 207 is electrically connected to the antenna trace conductor 202 through a buried via connection 203 in the vicinity of the first corner position 208. The finish end conductor layer portion 207 may have an L-shaped configuration such that the finish end conductor layer portion 207 is disposed in proximity to the combination cross-over member and finish connection 134 of antenna trace 102. However, other configurations such as straight or angular configurations may be employed for the finish end conductor layer portion 207. The embodiments are not limited in this context.

In a manner similar to the configuration of antenna trace conductor 102, antenna trace conductor 202 may be configured as a rectangular spiral as illustrated in FIG. 3. Again, alternate configurations such as square, circular, elliptical, or other such shapes may be employed. The embodiments are not limited in this context. The finish end conductor layer portion 207 forms one end of the rectangular spiral while the start end conductor layer portion 206 forms another end of the rectangular spiral. In conjunction with the rectangular spiral configuration, the receive antenna trace conductor 202 may be configured to be disposed at the interior region 162 of the substrate or base insulating layer 160 such that the transmit antenna trace conductor 102 substantially bounds the receive antenna trace conductor 202.

In the vicinity of the first corner region 208 with the finish end conductor layer portion 207, the antenna trace conductor 202 proceeds in an inward spiral to second, third and fourth corner regions 210, 212 and 214, respectively, to form a first loop 216. At the first corner region 208, the antenna trace conductor 202 proceeds to form a second loop 218, parallel to first loop 216, in an inward spiral to second, third and fourth corner regions 210, 212 and 214, respectively. Similarly, at the first corner region 208, the antenna trace conductor 202 proceeds to form a third loop 220, parallel to first loop 216 and second loop 218, in an inward spiral to second, third and fourth corner regions 210, 212 and 214, respectively. Fourth, fifth, sixth, seventh and eighth loops 222, 224, 226, 228 and 230 are formed in a similar manner. Those skilled in the art will recognize that a greater or a fewer number of loops 216 to 230 may be employed to configure the antenna 201, and that eight loops 216 through 230 are by way of illustration only. Therefore, the antenna 101 is configured to have a multiplicity of loops such as loops 216 to 230. In addition, although the loops 216, 218, 220, 222, 224, 226, 228 and 230 are described as spiraling inwardly, the loops 216, 218, 220, 222, 224, 226, 228 and 230 may be described as, or installed on the common planar surface 165 of substrate or base insulating layer 160 in a manner so as to effect, an outward spiral as opposed to an inward spiral. The embodiments are not limited in this context.

In the vicinity of the first corner region 208, the loop 230 terminates at a winding trace termination 232 substantially transverse to the first through eighth parallel loops 216 through 230. At termination position 232, the antenna trace portion 202 interfaces with the start end conductor layer portion 206. The start end conductor layer portion 206, via a cross-over member 234, crosses either under or over the finish end conductor layer portion 207 to form the receiver end cross-over region 236 in the vicinity of the first corner 208.

In one embodiment, the cross-over member 234 is in electrical communication with the antenna trace conductor 202 through a via connection 238 disposed in proximity to the winding trace termination 232. The cross-over member 234 extends either under, as shown in FIG. 3, or over (not shown) the first through eighth parallel loops 216 through 230, and also under the first, second and third loops 116, 118 and 120 of antenna trace 102 to a receiver finish termination 240. As a result, the finish connection 240 is in electrical communication with the antenna trace conductor 202 through the via connection 238.

As best shown in FIGS. 3B and 3C, in a similar manner as explained above with respect to antenna assemblies 100 and 100', the receiver end crossover region 236 includes the antenna trace conductor 102 and the base insulating layer 160 disposed between loops 116, 118 and 120 of antenna trace conductor 102 and between both the finish end conductor layer portion 207 and the start end conductor layer portion 206. The base insulating layer 160 is disposed also between the start end conductor layer portion 206 and the associated loops 216 through 230 of the antenna trace conductor 202. Therefore, the start end conductor layer portion 104 and the finish end conductor layer portion 106' are electrically isolated from each other. Also, the finish end conductor layer portion 207 and the start end conductor layer portion 206 are electrically isolated from each other.

As illustrated in FIGS. 3B, 3B', 3C, 3C', 3D and 3D', the antenna assembly 200*a* or 200*b* may also include the top cover or second insulating layer 170. More particularly, the antenna assembly 200 is configured such that the electrically conductive members included in the end cross-over regions 126' and 236, and the antenna trace conductors 102 and 202, are formed in a thin film and made of materials as previously described for end cross-over regions 126 and 126' and antenna trace conductor 102. The electrically insulating members such as the substrate or support insulating layer 150, the base insulating layer 160, and the top cover or enclosure insulating layer 170 are each constructed of a thin film made from a thin film material as described previously.

Specifically referring to FIG. 3B, as a result of construction using the thin film material, a total maximum height H3 is defined by the thickness of the finish end conductor layer portion 207, the base insulating layer 160 over the finish end conductor layer portion 207, and the first, second and third parallel loops 116, 118 and 120 over the base insulating layer 160. The total maximum height H3 ranges up to about 0.7 mm.

In one embodiment, when the antenna assembly 200*a* or 200*b* further includes the support or bottom insulating layer 150 and the enclosure insulating layer or top cover 170, a total maximum height H3' is defined by the thickness of the support or bottom insulating layer 150, the finish end conductor layer portion 207 over the support insulating layer 150, the base insulating layer 160 over the finish end conductor layer portion 207, the first, second and third parallel loops 116, 118 and 120 over the base insulating layer 160, and the enclosure insulating layer or top cover 170 over the first, second and third parallel loops 116, 118 and 120. The total maximum height H3' ranges up to about 1.3 mm although dimensions as large as about 15 mm are possible.

In one embodiment, the antenna assembly 200 may be configured such that when the support or bottom insulating layer 150 and/or the top cover 170 are/is omitted, the total maximum height H3 equals the total maximum height H3' when the support or bottom insulating layer 150 and/or top cover 170 are/is included.

Specifically referring to FIG. 3C, as a result of construction using the thin film material, a height H4 is defined by the thickness of the receiver end crossover region 236, the base insulating layer 160 over the receiver end crossover region 236, and the first, second and third parallel transmitter loops 116, 118 and 120 and the first through eighth parallel receiver loops 216, 218, 220, 222, 224, 226, 228 and 230 over the base insulating layer 160. The height H4 ranges up to about 0.7 mm.

In one embodiment, when the antenna assembly 200*a* or 200*b* further includes the support or bottom insulating layer 150 and/or the enclosure insulating layer or top cover 170, a total maximum height H4' is defined by the thickness of the support or bottom insulating layer 150, receiver end crossover region 236 over the support insulating layer 150, the base insulating layer 160 over the receiver end crossover region 236, the first, second and third parallel transmitter loops 116, 118 and 120 and the first through eighth parallel receiver loops 216, 218, 220, 222, 224, 226, 228 and 230 over the base insulating layer 160, and the enclosure insulating layer or top cover 170 over the first, second and third parallel transmitter loops 116, 118 and 120 and over the first through eighth parallel receiver loops 216, 218, 220, 222, 224, 226, 228 and 230. The total maximum height H4' ranges up to about 1.3 mm although dimensions as large as about 15 mm are possible.

In one embodiment, the antenna assembly 200 may be configured such that when the support or bottom insulating layer 150 and/or the top cover 170 are/is omitted, the height H4 equals the total maximum height H4' when the support or bottom insulating layer 150 and/or the top cover 170 are/is included.

Furthermore, as illustrated in FIG. 3B, in a similar manner as previously described with repect to antenna assembly 100*a* and 100*a*', structure, e.g., floor 5 of an establishment or edifice includes substructure, e.g., subfloor 10 and covering, e.g., flooring or floor covering 20. The antenna assembly 200*a*, including the finish end conductor layer portion 207 of the receiver antenna 201, is configured with thin film materials as applied to the first loop 216, as shown, of the receiver antenna 201 and to the first, second and third parallel loops 116, 118 and 120, respectively, of the transmitter antenna 101' and the electrically insulating layers 150, 160 and 170, to have a total thickness, as represented by the total maximum height H3', such that the antenna assembly 200*a* may be disposed between the subfloor 10 and the flooring or floor covering 20, without significantly altering the structural features of the floor or causing a deleterious effect to pedestrians or pedestrian traffic on the floor.

Similarly, as illustrated in FIG. 3C, the antenna assembly 200, including the start end conductor layer portion 206 of the receiver antenna 201, is also configured with thin film materials as applied to the first through eighth loops 216, 218, 220, 222, 224, 226, 228 and 230, respectively, of the receiver antenna 201, and to the cross-over member 236 of the receiver end cross-over region 236, and to the first, second and third parallel loops 116, 118 and 120, respectively, of the transmitter antenna 101' and the electrically insulating layers 150, 160 and 170, to have a total thickness, as represented by the total maximum height H4', such that the antenna assembly 200 may be disposed between the subfloor 10 and the flooring or floor covering 20, without significantly altering the structural features of the floor or causing a deleterious effect to pedestrians or pedestrian traffic on the floor.

As discussed above, the total maximum height H3' and the total maximum height H4' each range up to about 15 mm, although in most applications, the total maximum heights" H3' and H4' range up to about 1.3 mm. Additionally, in most applications, the total maximum height 3' equals the total maximum height H4'. The length L1 and width W1 of the antenna assembly 200*a* or 200*b* again may be in the range of about 155 cm by about 65 cm, respectively, the embodiments are not limited in this context.

Referring also to FIGS. 3B, 3B' and 3C', it can be further appreciated that housing assembly 2200 and antenna assembly 200*b* are essentially identical to housing assembly 2100 and antenna assembly 200*a* but also with the exception that the support insulating layer 150' on which the crossover member 236 is disposed merges by the upward bend 151 with the base insulating layer 160 to form the corner region or joint 156. The dummy or filler insulation 155 is again omitted throughout the antenna assembly 200*b* except for the region of the finish end conductor layer portion 207 and the cross-over member 236, respectively.

Referring to FIGS. 3 and 3D, it can be appreciated that housing assembly 2100 is constructed in a similar manner to housing assemblies 1100 and 1100'. More particularly, housing assembly 2100 includes an outer wall 2110 and an inner wall 2120 in which the antenna assembly 200*a* is housed. The inner wall 2120 encloses a region 2130 which may be empty space. The housing assembly 2100 may be hermetically sealed via joints 180.

Similarly, referring to FIGS. 3 and 3D', it can be appreciated that housing assembly 2200 is constructed in a similar manner to housing assemblies 1200 and 1200'. More particularly, housing assembly 2200 includes an outer wall 2210 and an inner wall 2220 in which the antenna assembly 200*a* is housed. The inner wall 2220 encloses a region 2230 which may be empty space. The housing assembly 2200 may also be hermetically sealed via joints 180.

However, housing assemblies 2100 and 2200 differ from housing assemblies 1100, 1100' and from housing assemblies 1200, 1200', respectively in that the series of mounting sleeves 1011 (see FIGS. 3 and 3D) and 1012 (see FIGS. 3 and 3D') may now be more suitably positioned in a region 250 that generally forms a gap or interface between the outer periphery of the receiver windings, specifically receiver winding 216, and the inner periphery of the transmitter windings, specifically transmitter winding 120. However, the installation procedure is otherwise essentially the same as described previously with respect to housing assemblies 1100, 1200, 1100', and 1200'.

Figure 4:
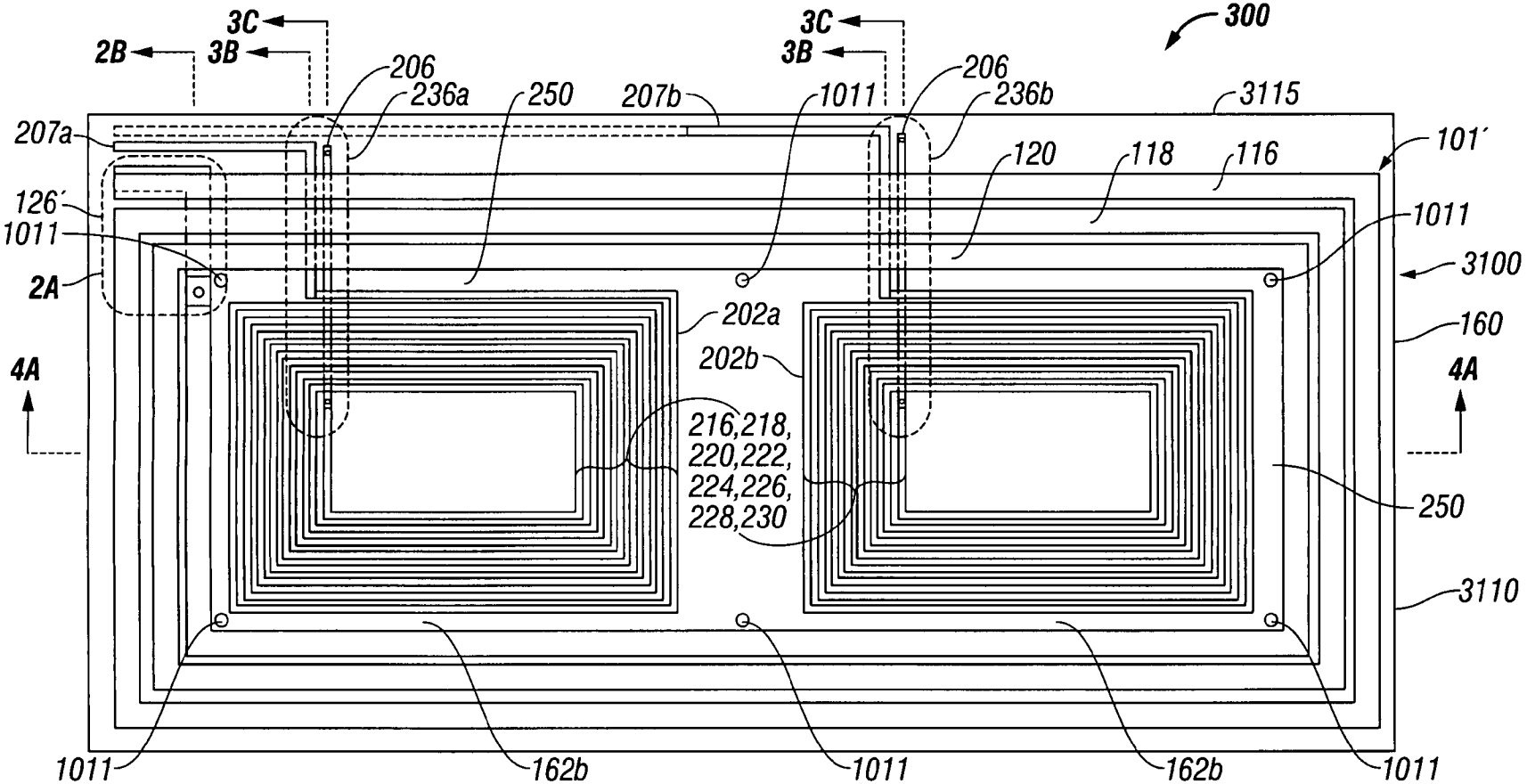
FIG. 4 is a plan view illustrating one embodiment of an air core antenna assembly showing a single transmitter winding with multiple receiver windings and partially illustrating a housing assembly housing the antenna assembly according to the present disclosure.
Figure 4A:
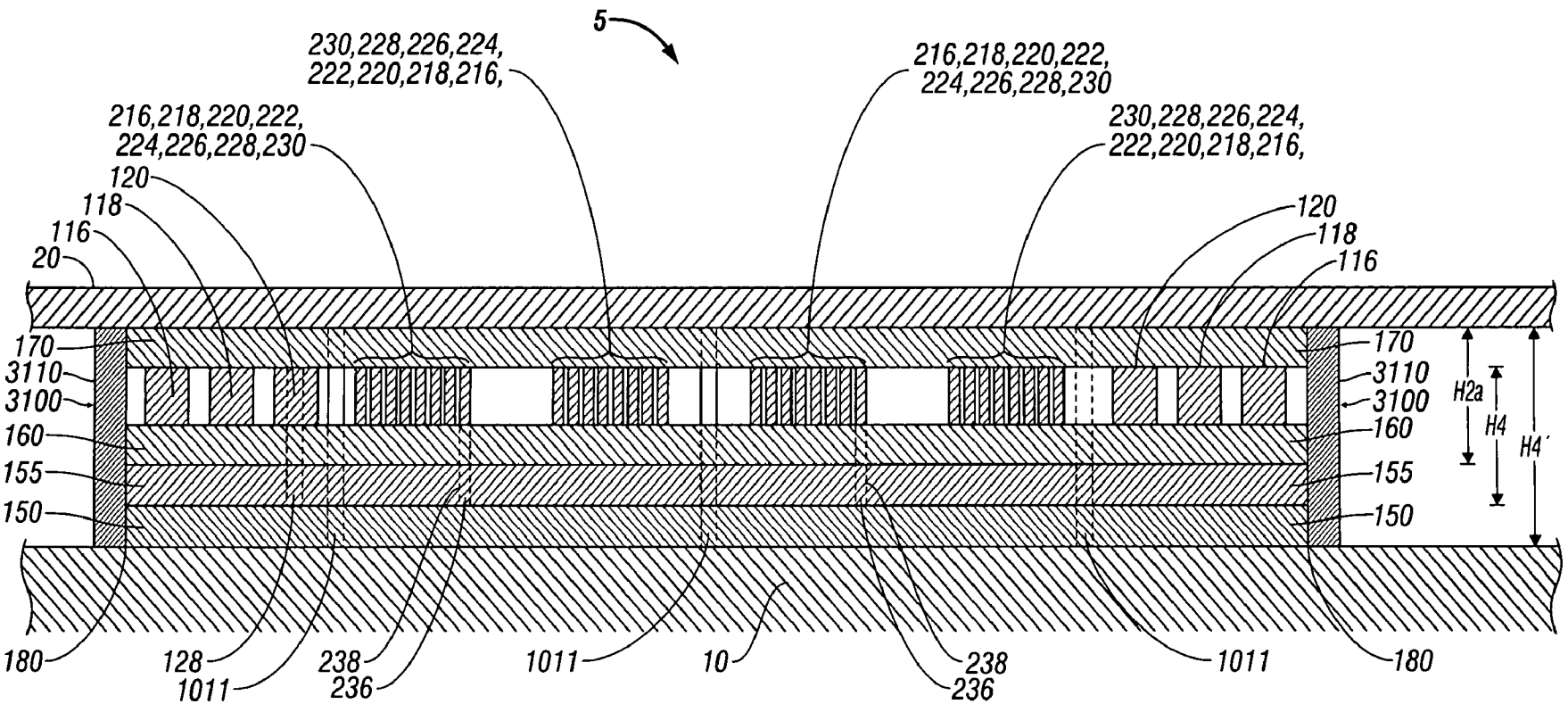
FIG. 4A is a cross-sectional elevation view of the antenna assembly and housing assembly completely illustrated taken along section line 4A-4A of FIG. 4 and disposed in a floor.

FIGS. 4 and 4A illustrate another embodiment of an air core antenna assembly 300 which includes a single transmitter with multiple receiver windings using thin film construction according to the present disclosure. Again, for purposes of simplification, FIG. 4 only partially illustrates a housing assembly 3100 housing the antenna assembly 300. More particularly, antenna assembly 300 includes the antenna 101' (see FIG. 2) disposed on the common planar surface 165 of substrate or base insulating layer 160. Antenna 101' includes the antenna trace conductor 102 having start end conductor layer portion 104 and finish end conductor layer portion 106'.

Antenna assembly 300 is identical to antenna assembly 200*a* or 200*b* except that instead of the transmit antenna trace conductor 102 substantially bounding a single receive antenna trace conductor 202 (see FIG. 3), the transmit antenna trace conductor 102 is configured on the common planar surface 165 of substrate or antenna assembly base insulating layer 160 to substantially bound a multiplicity of receive antenna trace conductors 202, such as first and second receive antenna trace conductors 202*a* and 202*b*, respectively, disposed at the interior region 162 of the substrate or base insulating layer 160. As a result, a first receiver cross-over region 236*a* associated with first receive antenna trace conductor 202*a* and a second receiver cross-over region 236*b* associated with second receive antenna trace conductor 202*b* are separately disposed to traverse the first, second and third loops 116, 118 and 120 of transmit antenna trace conductor 102.

The first and second receiver cross-over regions 236*a* and 236*b* are the same as receiver cross-over region 236 with the exception that cross-over regions 236*a* and 236*b* each include a receiver finish end conductor layer portion 207*a* and 207*b*, respectively, that is disposed such that, in addition to receiver finish end conductor layer portion 207*a* being disposed in proximity to the combination cross-over member and finish connection 134 of antenna trace 102, L-shaped receiver finish end conductor layer portion 207*b* may be extended to be disposed in proximity to receiver finish end conductor layer portion 207*a* in the corner 108 of the substrate or support insulating layer 150.

Again, in a similar manner, the antenna assembly 300 is configured such that the antennas 101' and 201 and the base insulating layer 160 are each constructed of a thin film made from a thin film material.

As illustrated in FIGS. 2B, 3B and 3C, the antenna assembly 300 may also include the top cover or enclosure insulating layer 170 at least partially disposed on or over the antenna assembly 300 and over the common planar surface 165. More particularly, the antenna assembly 300 is configured such that the electrically conductive members such as transmitter end cross-over region 126', the first and second receiver end cross-over regions 236*a* and 236*b*, and the antenna trace conductors 102 and 202, respectively, are constructed of thin films made from a thin film material as discussed previously with respect to end cross-over region 126 and antenna trace conductor 102. Similarly, the electrically insulating members such as the substrate or support insulating layer 150, the base insulating layer 160, and the top cover or enclosure insulating layer 170 are each constructed of a thin film made from a thin film material, as described previously.

FIG. 4A is a cross-sectional elevation view of the antenna assembly 300 with the housing assembly 3100 being completely illustrated as taken along section line 4A-4A of FIG. 4. The housing assembly 3100 is very similar to the previously described housing assemblies 1100, 1200, 1100', 1200', 2100, and 2200. The differences occur in that due to the generally larger surface area requirements for the combined transmitter assembly 102 and the first and second receive antenna trace conductors 202*a* and 202*b*, respectively, only an outer wall 3110 extending around the outer periphery 3115 of the housing assembly 3100 may be required and an inner wall, e.g., inner walls 2120 and 2220 illustrated in FIG. 3, along the inner peripheries of the first and second receive antenna trace conductors 202*a* and 202*b*, respectively, may be omitted if desired. However, such inner walls may be included where desired and practical. The embodiments are not limited in this context. Those skilled in the art will recognize that, and understand how, mounting rings or sleeves 1011 may be positioned within the housing assembly 3100 as illustrated previously in FIG. 3 with respect to housing assemblies 2100 and 2200.

Although not shown, those skilled in the art will recognize that, and understand how, housing assembly 3100 may be constructed without the dummy or filler insulation 155 or the antenna assembly support insulating manner 160, so as to be analogous to housing assemblies 1200, 1200' or 2200. The embodiments are not limited in this context.

Similarly, the installation procedure for the housing assembly 3100 within the substructure or sub floor 10 and covering or floor covering 20 is otherwise essentially the same as described previously with respect to housing assemblies 1100, 1200, 1100', and 1200'.

Figure 5:
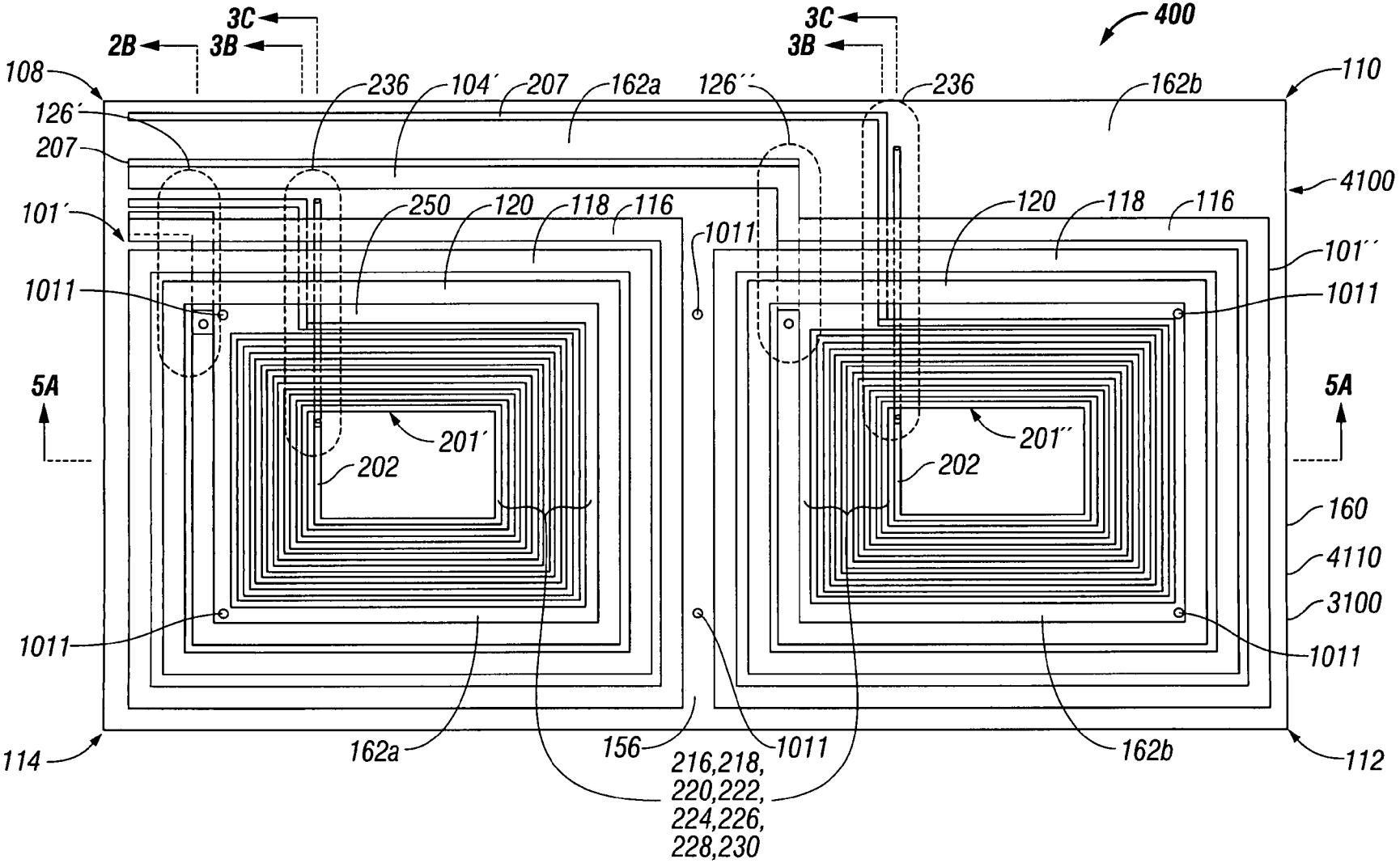
FIG. 5 is a plan view illustrating one embodiment of an air core antenna assembly with multiple transmitter and multiple receiver windings and partially illustrating a housing assembly housing the antenna assembly according to the present disclosure.
Figure 5A:
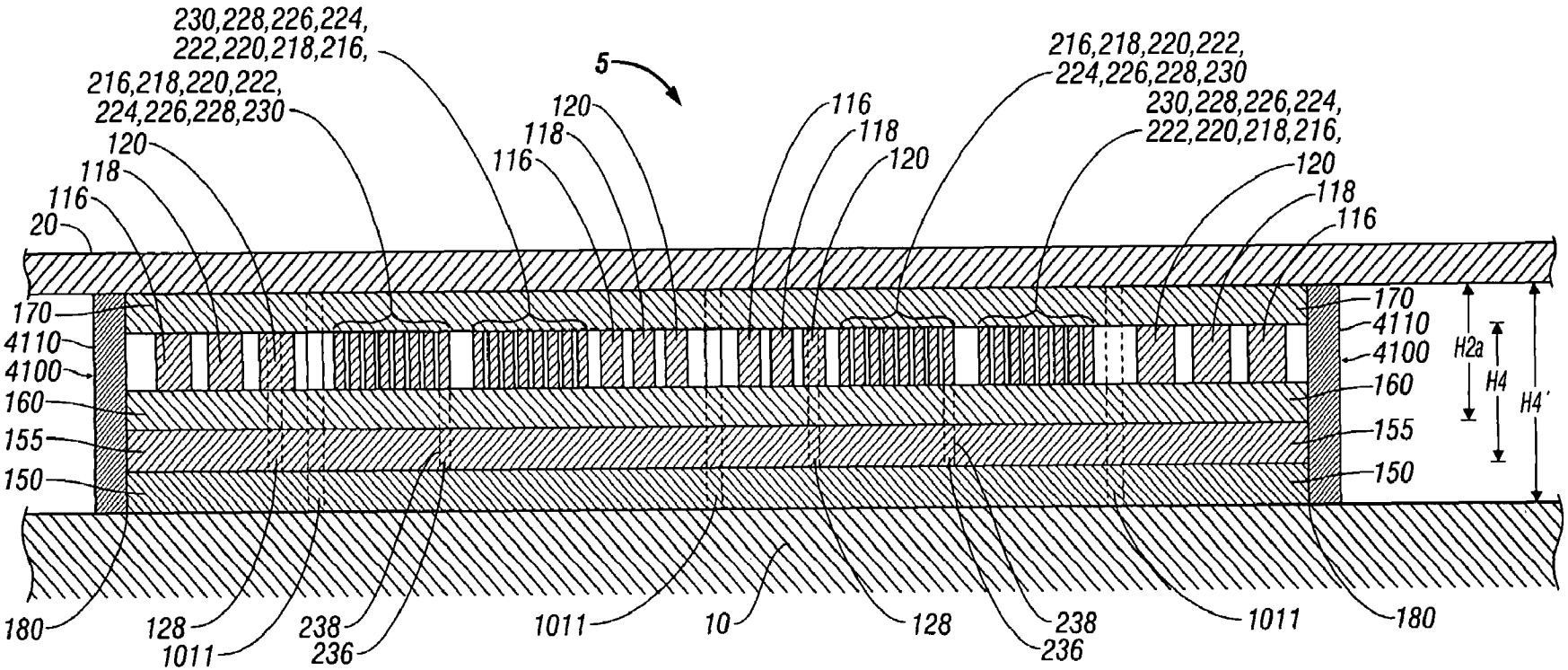
FIG. 5A is a cross-sectional elevation view of the antenna assembly and housing assembly completely illustrated taken along section line 5A-5A of FIG. 5 and disposed in a floor.

FIGS. 5 and 5A illustrate still another embodiment of an antenna assembly which includes multiple transmitter and receiver windings according to the present disclosure. Again for purposes of simplification, FIG. 5 only partially illustrates a housing assembly 4100 housing an air core antenna assembly 400. More particularly, antenna assembly 400 includes a multiple set of the transmitter antenna 101' (see FIG. 2) and receiver antenna 201 (see FIG. 3) disposed on the substrate or support insulating layer 150. Antenna 101' includes the antenna trace conductor 102 having start end conductor layer portion 104 and finish end conductor layer portion 106'.

Antenna assembly 400 is similar to antenna assembly 200, the difference being that instead of a single set of a transmitter antenna 101' and a receiver antenna 201, a multiple set of antennas is disposed on the substrate or base insulating layer 160. More particularly, a first set which includes the single set of transmitter antenna 101' and receiver antenna 201' may be disposed at least partially or substantially on or over a first portion 162*a* of the common planar surface 165 of substrate or base insulating layer 160 while at the same time, a second set which includes a transmitter antenna 101" and receiver antenna 201", may be disposed at least partially or substantially on or over a second portion 162*b* of the common planar surface 165 of substrate or base insulating layer 160.

The first set of transmitter antenna 101' and receiver antenna 201' includes the end cross-over region 126' and receiver cross-over region 236. The transmitter antenna 101" of the second set is substantially identical to transmitter antenna 101' with the exception that the transmitter antenna 101" includes an end cross-over region 126" wherein a start end portion 104' has an L-shaped configuration such that the start end portion 104' extends to the corner region 108, in the first portion 162*a* of the substrate or base insulating layer 160, from the second portion 162*b* of the substrate or base insulating layer 160.

As illustrated also in FIGS. 2B, 3B and 3C, the antenna assembly 400 may also include the top cover or enclosure insulating layer 170 on or over the antenna assembly 400 and over the base insulating layer 160. In addition, the antenna assembly 400 is configured such that the electrically conductive members such as the transmitter end cross-over regions 126' and 126", and the receiver end cross-over regions 236, and the antenna trace conductors 102 and 202 are constructed of thin films made from a thin film material as discussed previously with respect to end cross-over region 126 and antenna trace conductor 102. Similarly, the electrically insulating members such as the substrate or support insulating layer 150, the base insulating layer 160, and the top cover or enclosure insulating layer 170 are each constructed of a thin film made from a thin film material, as described previously.

FIG. 5A is a cross-sectional elevation view of the antenna assembly 400 and housing assembly 4100 completely illustrated taken along section line 5A-5A of FIG. 5. As is the case for housing assembly 3100, the housing assembly 4100 is similar to the previously described housing assemblies 1100, 1200, 1100', 1200', 2100, and 2200. Again, the differences occur in that due to the generally larger surface area requirements for the transmitter assemblies 101' and 101" and the first and second receive antenna trace conductors 201' and 201", respectively, only an outer wall 4110 extending around the outer periphery 4115 of the housing assembly 4100 may be required and an inner wall along the inner peripheries of the first and second receive antenna trace conductors 201' and 201", respectively, may be omitted if desired. Again, such inner walls may be included where desired and practical. The embodiments are not limited in this context. Again, those skilled in the art will recognize that, and understand how, mounting rings or sleeves 1011 may be positioned within the housing assembly 4100 as illustrated previously in FIG. 3 with respect to housing assemblies 2100 and 2200.

The series of mounting rings or sleeves 1011 (see FIGS. 3 and 3D) may now be more suitably positioned in the region 250 that generally forms a gap or interface between the outer periphery of the receiver windings, specifically receiver winding 216, and the inner periphery of the transmitter windings, specifically transmitter winding 120. The installation procedure is otherwise again essentially the same as described previously with respect to housing assemblies 1100, 1200, 1100', and 1200'.

Although not shown, those skilled in the art will recognize that, and understand how, housing assembly 4100 may be constructed without the dummy or filler insulation 155 or the antenna assembly support insulating manner 160, so as to be analogous to housing assemblies 1200, 1200' or 2200. The embodiments are not limited in this context.

Similarly, the installation procedure for the housing assembly 4100 within the substructure or sub floor 10 and covering or floor covering 20 is otherwise essentially the same as described previously with respect to housing assemblies 1100, 1200, 1100', and 1200'.

Figure 6:
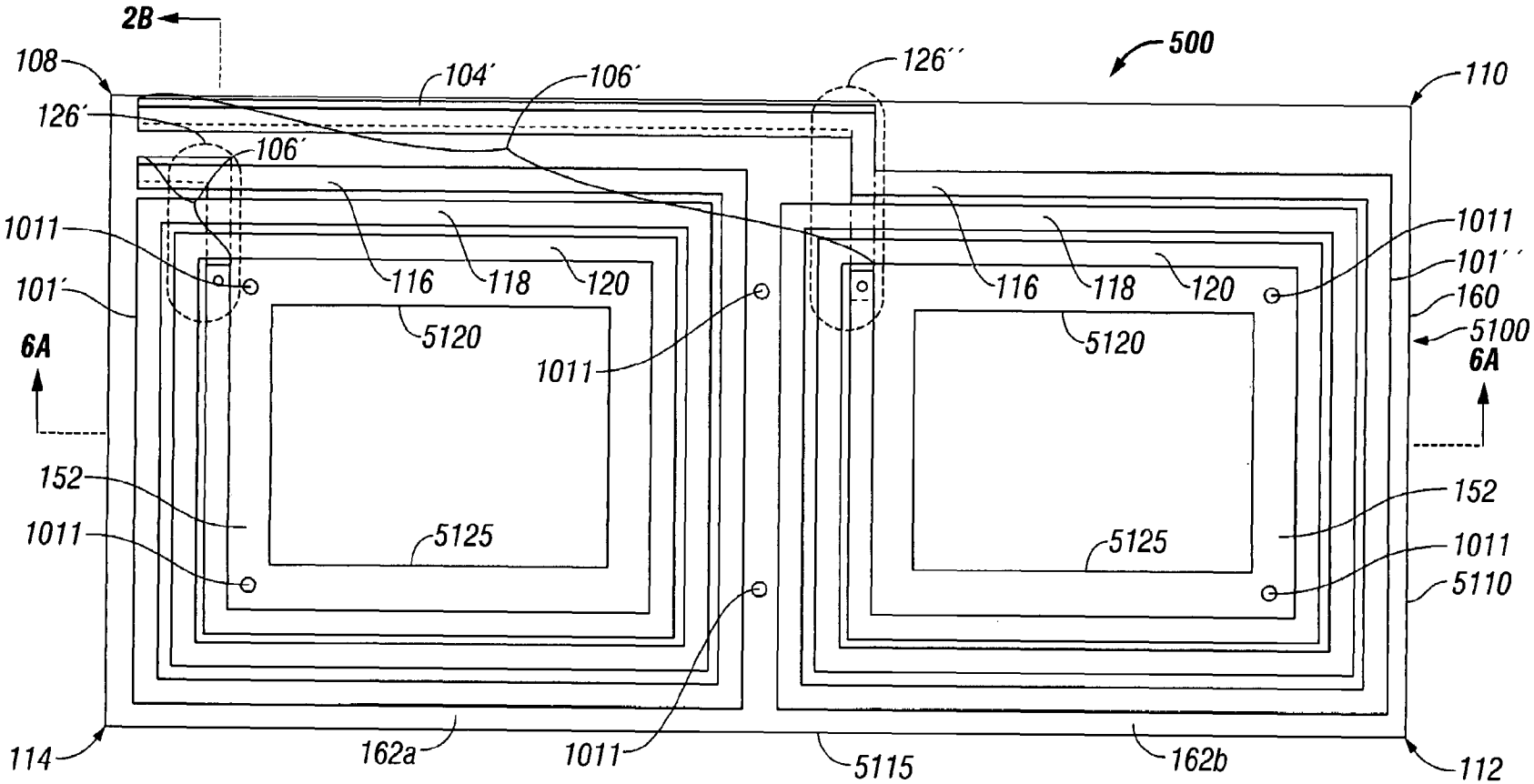
FIG. 6 is a plan view illustrating one embodiment of an air core antenna assembly with multiple transceiver windings and partially illustrating a housing assembly housing the antenna assembly according to the present disclosure.
Figure 6A:
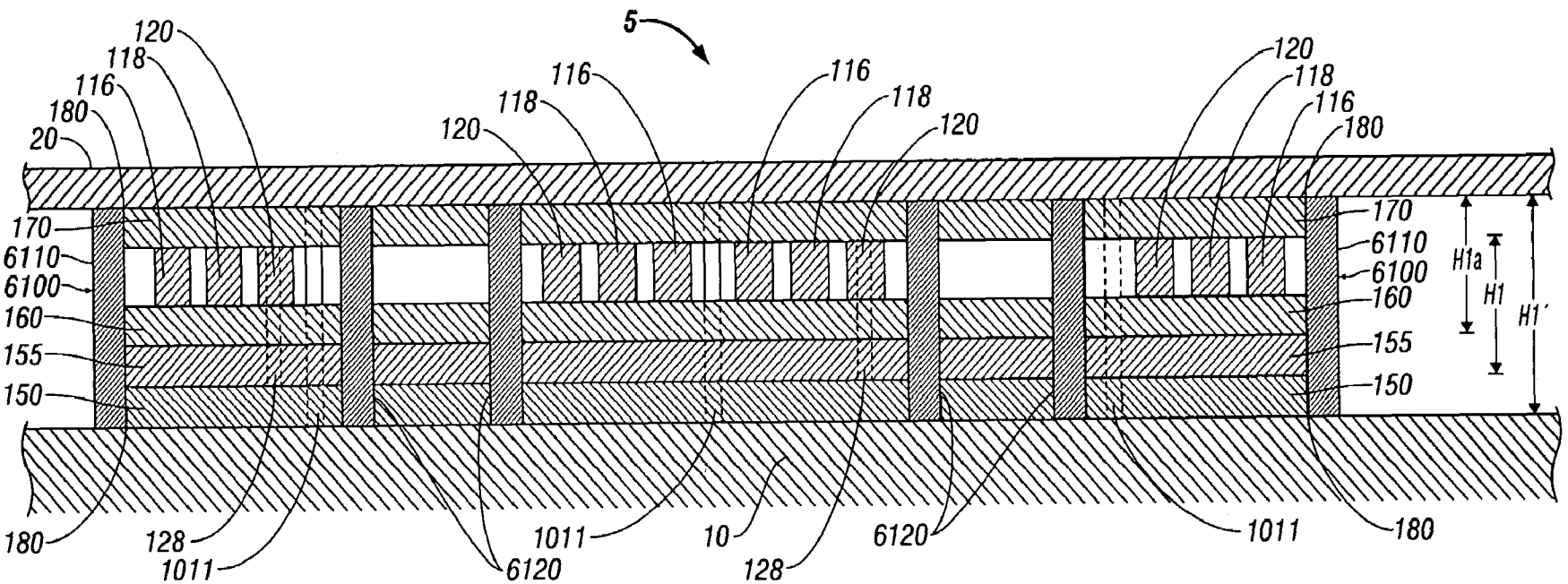
FIG. 6A is a cross-sectional elevation view of the antenna assembly and housing assembly completely illustrated taken along section line 6A-6A of FIG. 6 and disposed in a floor.

FIGS. 6 and 6A illustrate yet another embodiment of an antenna assembly which includes multiple transceiver windings according to the present disclosure. Yet again, for simplification, FIG. 6 only partially illustrates a housing assembly 5100 housing the antenna assembly 500. FIG. 6A is a cross-sectional elevation view of the antenna assembly 500 and housing assembly 5100 completely illustrated taken along section line 6A-6A of FIG. 6. More particularly, antenna assembly 500 may include at least one of the single transmitter or transceiver antenna 101' (see FIG. 2) and at least one of the single transmitter or transceiver antenna 101" (see FIG. 5) each at least partially disposed on the common planar surface 165 of substrate or base insulating layer 160. Antenna 101' includes the antenna trace conductor 102 having start end conductor layer portion 104 and finish end conductor layer portion 106'. Antenna 101" includes the start end conductor layer portion 104' and the finish end conductor layer portion 106'.

Antenna assembly 500 is similar to antenna assembly 400, the difference being that antenna assembly 500 excludes the receiver antennas 201. More particularly, the transmitter antenna 101' is disposed substantially on the first portion 162*a* of the substrate or base insulating layer 160 while at the same time, the transmitter antenna 101" is disposed substantially on the second portion 162*b* of the substrate or base insulating layer 160.

The first set of transmitter antenna 101' includes the end cross-over region 126'. The transmitter antenna 101" includes a second end cross-over region 126" which may include the start end portion 104'. The start end portion 104' may have an L-shaped configuration such that the start end portion 104' may extend to the corner region 108, in the first portion 162*a* of the substrate or base insulating layer 160, from the second portion 162*b* of the substrate or base insulating layer 160.

As illustrated also in FIG. 2B, the antenna assembly 500 may also include the top cover or enclosure insulating layer 170 at least partially disposed on or over the antenna assembly 500. In addition, the antenna assembly 500 is configured such that electrically conductive members such as the first and second cross-over end regions 126' and 126", and the antenna trace conductor 102, are constructed of thin films made from a thin film material as discussed previously with respect to end cross-over region 126 and antenna trace conductor 102. Similarly, the electrically insulating members such as the substrate or support insulating layer 150, the base insulating layer 160, and the top cover or enclosure insulating layer 170 are each constructed of a thin film made from a thin film material, as described previously.

FIG. 6A is a cross-sectional elevation view of the antenna assembly 500 and housing assembly 5100 completely illustrated taken along section line 6A-6A of FIG. 6. As is the case for housing assembly 4100, the housing assembly 5100 is similar to the previously described housing assemblies 1100, 1200, 1100', 1200', 2100, and 2200. In that only the first and second transmitter assemblies 101' and 101", respectively, are mounted on or over the common planar surface 165 of the base insulating layer 160, the surface area of the antenna assembly 500 may accommodate both an outer wall 5110 extending around the outer periphery 5115 of the housing assembly 5100 and an inner wall 5120 along the inner periphery 5125 of the first and second transmitter assemblies 101' and 101", respectively. Again, such inner walls may be omitted where desired and practical. The embodiments are not limited in this context. Again, those skilled in the art will recognize that, and understand how, mounting rings or sleeves 1011 may be positioned within the housing assembly 5100 as illustrated previously for example in FIG. 1 with respect to housing assemblies 1100 and 1200.

Although not shown, those skilled in the art will recognize that, and understand how, housing assembly 5100 may be constructed without the dummy or filler insulation 155 or the antenna assembly support insulating manner 160, so as to be analogous to housing assemblies 1200, 1200' or 2200. The embodiments are not limited in this context.

Similarly, the installation procedure for the housing assembly 5100 within the substructure or sub floor 10 and covering or floor covering 20 is otherwise essentially the same as described previously with respect to housing assemblies 1100, 1200, 1100', and 1200'.

Those skilled in the art will recognize that the dimensions for total maximum height H2 and H2' illustrated in FIG. 2B, dimensions H3 and H3' illustrated in FIG. 3B, and dimensions H4 and H4' illustrated in FIG. 3C are applicable to the antenna assemblies 300 (see FIG. 4) and 400 (see FIG. 5) such that the antenna assemblies 300 and 400 may each be disposed between the subfloor 10 and the flooring or floor covering 20, without significantly altering the structural features of the floor or causing a deleterious effect to pedestrians or pedestrian traffic on the floor. Similarly, the dimensions for total maximum height H1 and H1' as illustrated in FIG. 1B are also applicable to the antenna assembly 500 such that the antenna assembly 500 may be disposed between the subfloor 10 and the flooring or floor covering 20, without significantly altering the structural features of the floor or causing a deleterious effect to pedestrians or pedestrian traffic on the floor.

Figure 7:
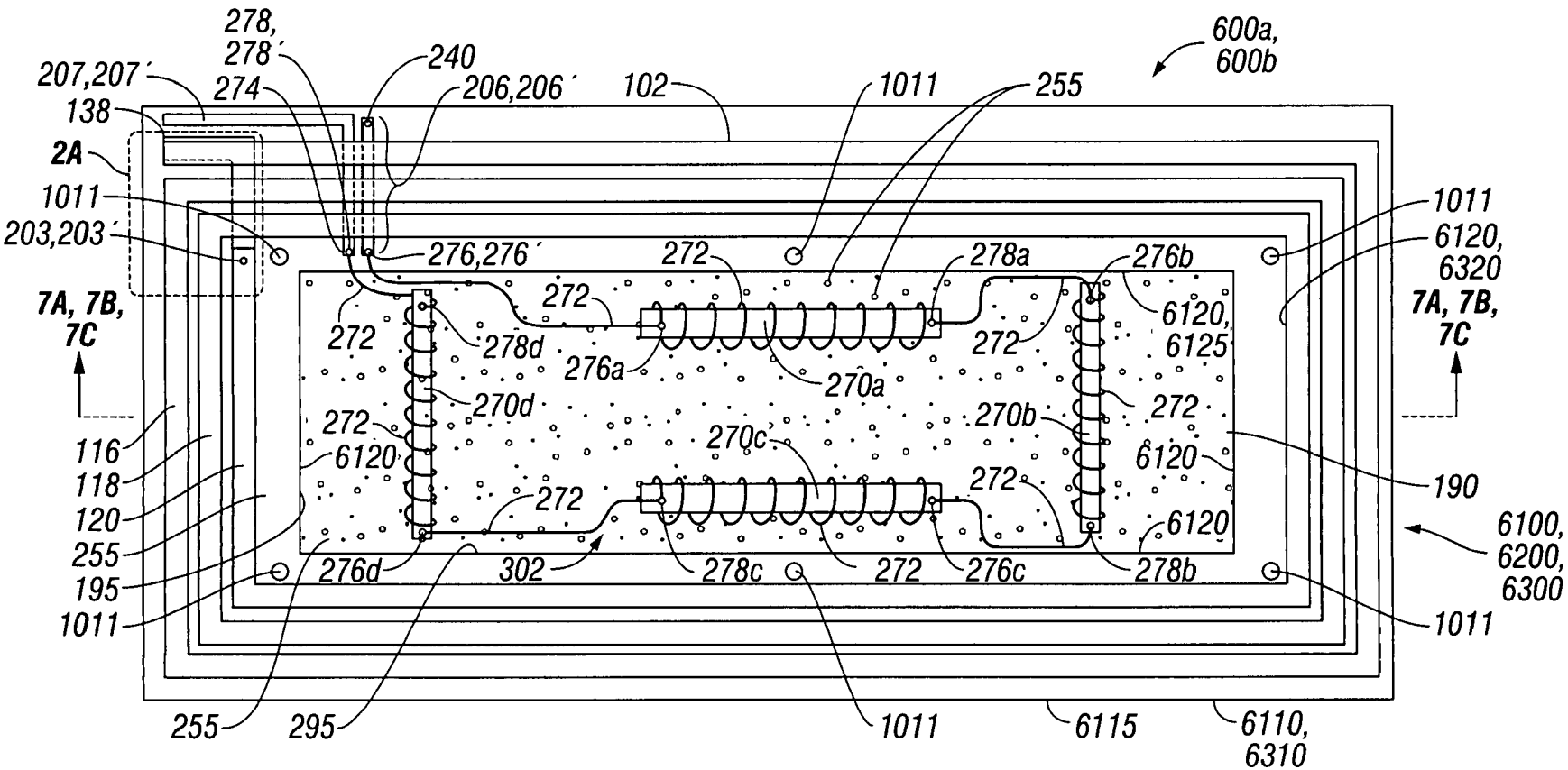
FIG. 7 is a plan view illustrating thin film conductors for an alternative antenna assembly having a transmitter antenna assembly with an internal compartment for a non-air core receiver antenna assembly and partially illustrating a housing assembly according to the present disclosure.
Figure 7A:
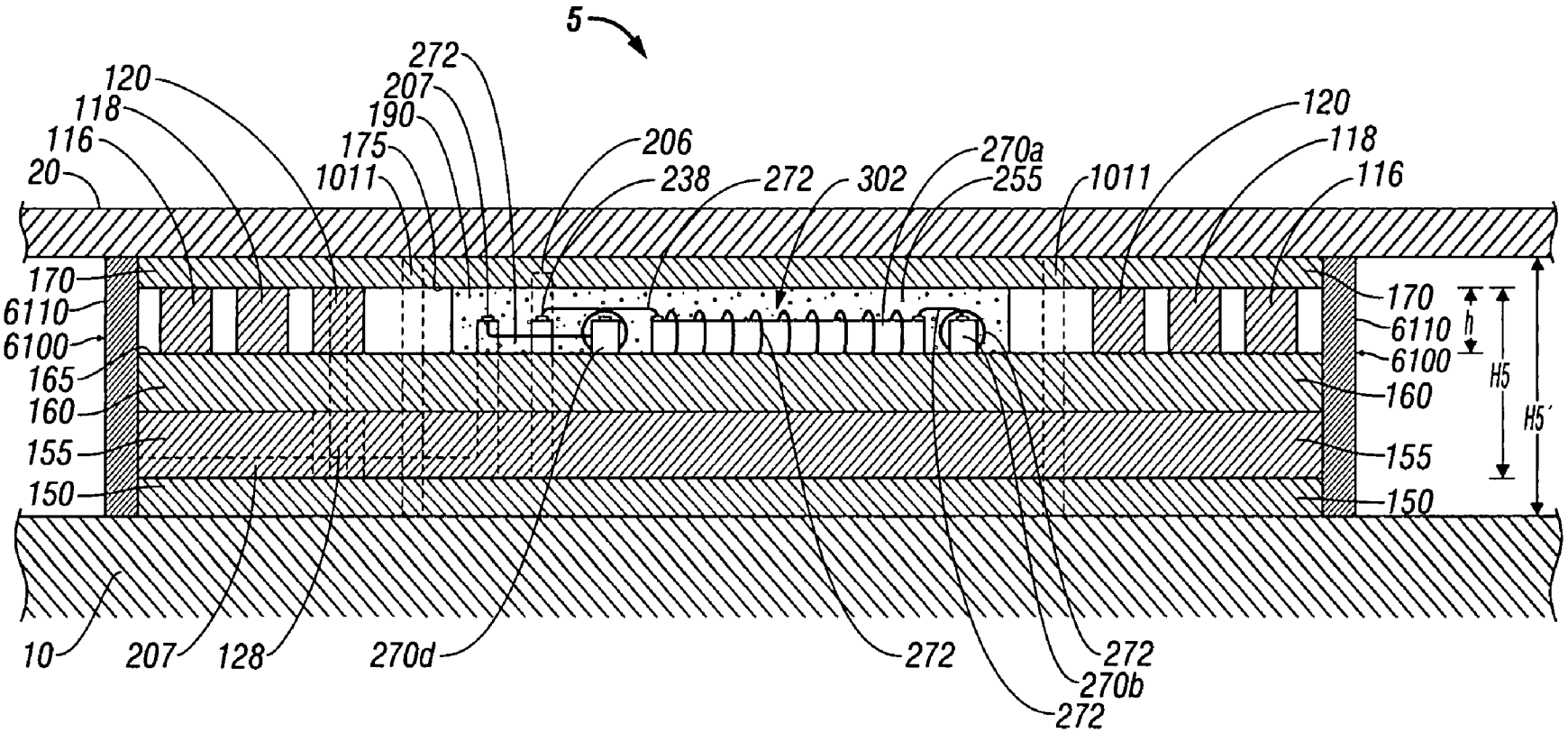
FIG. 7A is a cross-sectional elevation view of the antenna assembly of FIG. 7 with the housing assembly completely illustrated and taken along line 7A-7A of FIG. 7 and as disposed in a floor.

FIGS. 7 and 7A illustrate thin film conductors for an alternative antenna assembly 600*a* and a housing assembly 6100 having an internal compartment 190 for a non-air core receiver antenna according to the present disclosure. More particularly, FIG. 7 is a plan view of antenna assembly 600*a*. Antenna assembly 600*a* may include the transmitter antenna trace conductor 102 with first, second and third loops 116, 118 and 120, respectively, at least partially disposed on or over the base insulating layer 160, and particularly over the common planar surface 165 of the base insulating layer 160. In addition, one surface 175 of the enclosure or top cover insulating layer 170 is disposed over the antenna assembly 600*a* and over the common planar surface 165, and serves as an inner covering surface. As illustrated in FIG. 7A, in a similar manner to the aforementioned housing assemblies 1100, 1100', 1200, 1200', 2100, 2200, 3100, 4100 and 5100, the housing assembly 6100 includes by incorporation support insulating layer 150 as a lower lid and the enclosure insulating layer 170 as an upper lid of the housing assembly 6100. Outer and inner walls 6110 and 6120, having outer and inner peripheries 6115 and 6125, respectively, may be joined to the support insulating layer 150 and to the enclosure insulating layer 170 at joints 180 to form a hermetic seal. Inner covering surface 175 of the enclosure insulating layer 170 may extend entirely across over the common planar surface 165, so that the inner wall 6120 has height "h" representing the distance between common planar surface 165 and the inner covering surface 175. In conjunction with the inner wall 6120, the inner covering surface 175 and the common planar surface 165 form an internal compartment 190 in which may be disposed a magnetic material such as ferrite or an amorphous material. More particularly, referring to FIG. 7, the magnetic material may be a thin film material in the form of one or more long and thin ferrite or amorphous bars which may have dimensions such as about 25 mm wide (about 1 inch) by about 610 mm long (about 24 inches) by about 1.6 mm thick (about $1/16^{th}$ inch). Specifically, receiver start end conductor portion 206 is coupled at joint 276 to receiver finish end conductor portion 207 at joint 278 via a long continuous wire loop 272 that at least partially coils around at least one magnetic bar, e.g., magnetic bar 270*a*, formed of a thin film construction.

In particular, wire loop 272 extends from joint 276 to first end 276*a* of first magnetic bar 270*a*. The wire 272 extends along the bar 270*a* and is coiled around the first magnetic bar 270*a* in a manner similar to a solenoid and extends to second end 278*a* of the first magnetic bar 270*a*. From the second end 278*a*, the wire 272 extends to first end 276*b* of a second magnetic bar 270*b* where again the wire 272 is coiled around the bar 270*b* and extends to second end 278*b*. From second end 278*b*, the wire 272 extends to first end 276*c* of a third magnetic bar 270*c* around which the wire 272 is again coiled and extends to second end 278*c* of the bar 270*c*. Similarly, the wire 272 again extends from the second end 278*c* to first end 276*d* of a fourth magnetic bar 270*d*. The wire 272 again continues to extend from the first end 276*d* and is coiled around the bar 270*d*, extending to second end 278*d* of the bar 270*d*. The wire 272 then completes the loop by extending from the second end 278*d* to the joint 278 of receiver finish end conductor portion 207. In conjunction with the start end conductor portion 206 and the finish end conductor portion 207, the wire loop 272 and the start end conductor portion 206 and the finish end conductor portion 207 form a non-air core receiver antenna assembly 302. In effect, the non-air core receiver antenna assembly 302 replaces the air core receiver antenna assembly 201 described previously with respect to FIG. 3. The internal compartment 190 then may be filled with a filler insulating material 255 to prevent electrical shorting and electromagnetic interference (EMI) between the transmitter antenna assembly 102 and the receiver antenna assembly 302.

As illustrated in FIG. 7A, the base insulating layer 160 may be at least partially disposed on or over support insulating layer 150. The dummy or filler insulation material 155 may be at least partially, if not entirely, disposed between the base insulating layer 160 and the support insulating layer 150. In a similar manner as shown in FIG. 3A, the start end conductor layer portion 206 crosses under the transmitter windings 116, 118 and 120 through the via connection 238 and rises up to the vicinity of the covering surface 175 through the via connection 240. The finish end conductor layer portion 207, having an L-shaped configuration, descends below the transmitter windings 116, 118 and 120 to the level of the filler insulation layer 155 where the finish end conductor layer portion 207 terminates.

In a similar manner to housing assembly 1100, the housing assembly 6100 further includes the series of mounting sleeves 1011 that are positioned as required in the portions of the housing assembly 6100 adjacent to the inner periphery 6125. Again, six mounting sleeves 1011 by way of example are illustrated in FIG. 7, one each in the vicinity of the four corners formed by the internal compartment 190 and the inner periphery 6125 of the of the inner walls 6120, and one each midway in the lengthwise direction of housing assembly 6100 on either side of the inner periphery 6125.

In that the housing assembly 6100 includes the support or bottom insulating layer 150 and/or the enclosure insulating layer or top cover 170, a total maximum height H5' is defined by the thickness of the support or bottom insulating layer 150, the thickness of the dummy or filler insulating layer 155 over the support insulating layer 150, the base insulating layer 160 over the filler insulating layer 155, the thickness of the internal compartment 190 or the transmitter loop windings 116, 118 and 120 over the base insulating layer 160, and the thickness of the enclosure insulating layer or top cover 170 over the internal compartment 190 or the transmitter loop windings 116, 118 and 120. The total maximum height H5' ranges up to about 15 mm. A height H5 is defined by the thickness of the internal compartment 190 on or over the common planar surface 165 or the thickness of the transmitter loop windings 116, 118 and 120 plus the thickness of the base insulating layer 160, and the thickness of the dummy or filler insulation layer 155. The height dimension H5 ranges up to about 12 mm.

Figure 7B:
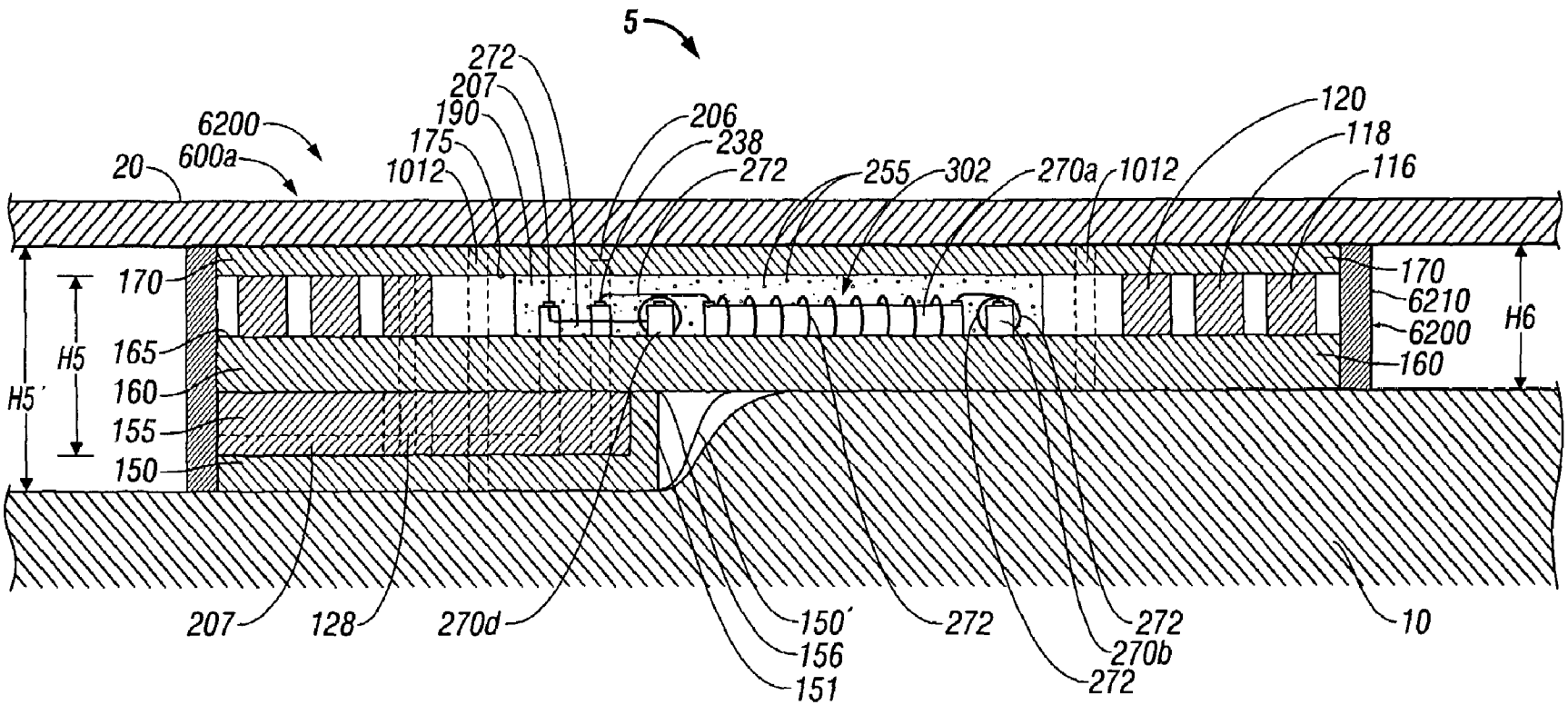
FIG. 7B is a cross-sectional elevation view of the antenna assembly of FIG. 7 and a variation of the completely illustrated housing assembly taken along line 7B-7B of FIG. 7 and as disposed in a floor.

In conjunction with FIG. 7B, FIG. 7 also illustrates a variation of the embodiment of antenna assembly 600*a*. More particularly, housing assembly 6200, which at least partially, if not entirely, encloses antenna assembly 600*a*, is in all respects identical with housing assembly 6100, which also encloses antenna assembly 600*a*, with the difference noted below. Specifically, antenna housing assembly 6200 encloses antenna assembly 600*a* which includes the transmitter antenna trace conductor 102 with first, second and third loops 116, 118 and 120, respectively, mounted on the common planar surface 165 of the base insulating layer 160. Housing assembly 6200 also encloses the non-air core receiver antenna assembly 302 in internal compartment 190. However, the support insulating layer 150' on which the finish end conductor layer portion 207 is disposed merges by the upward bend 151 with the base insulating layer 160 to form the corner region or joint 156. The dummy or filler insulation 155 is omitted throughout the antenna assembly 600*a* except for the region of the finish end conductor layer portion 207. In a manner analogous to mounting sleeves 1011 of housing assembly 6100, the housing assembly 6200 further includes the series of mounting sleeves 1012 that are positioned as required in the portions of the housing assembly 6200 adjacent to the periphery 195 of the internal compartment 190. A total maximum height H6 is defined by the thickness of the top cover or enclosure insulating layer 170, plus the thickness of the internal compartment 190 or the thickness of the transmitter loop windings 116, 118 and 120, and the thickness of the base insulating layer 160. The total maximum height H6 ranges up to about 12 mm.

Figure 7C:
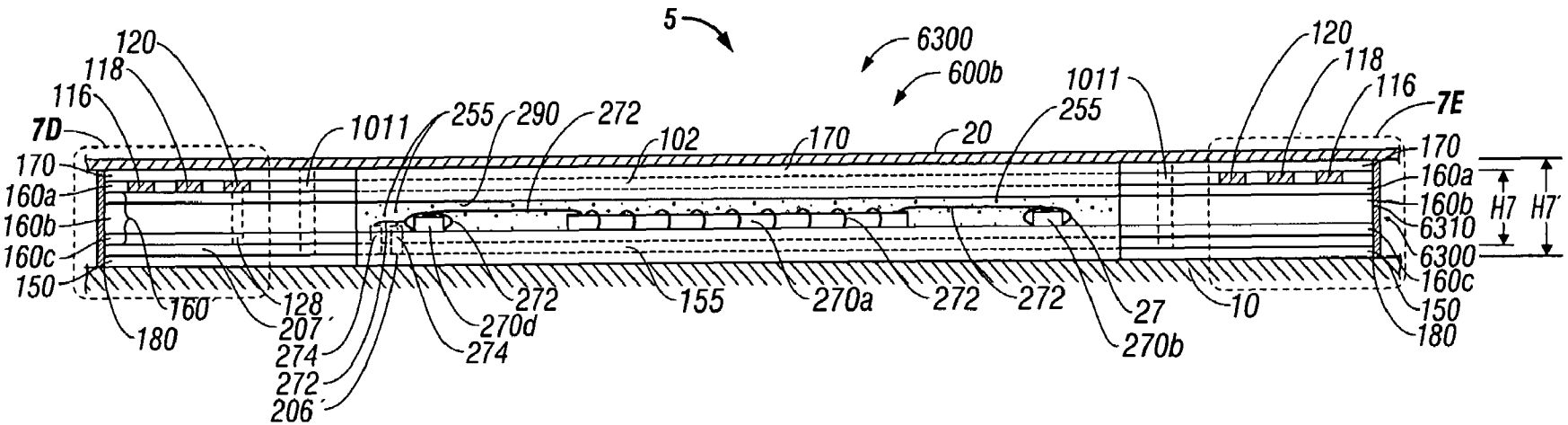
FIG. 7C is a cross-sectional elevation view of the antenna assembly of FIG. 7 and an alternate embodiment of the completely illustrated housing assembly taken along line 7C-7C of and as disposed in a floor.
Figure 7D:
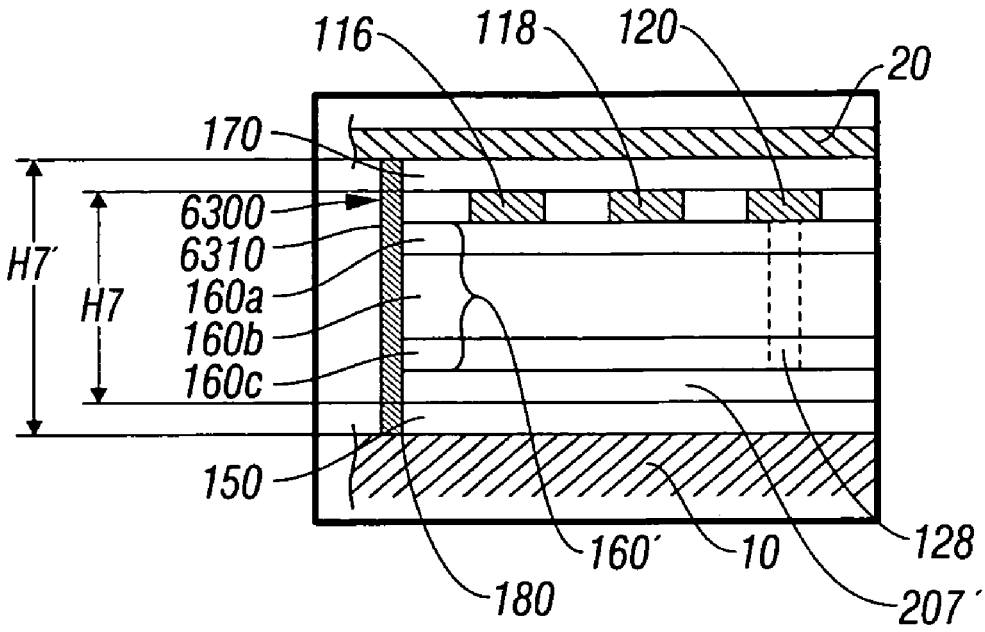
FIG. 7D is an enlarged view of a portion of the antenna assembly and housing assembly shown in FIG. 7C.
Figure 7E:
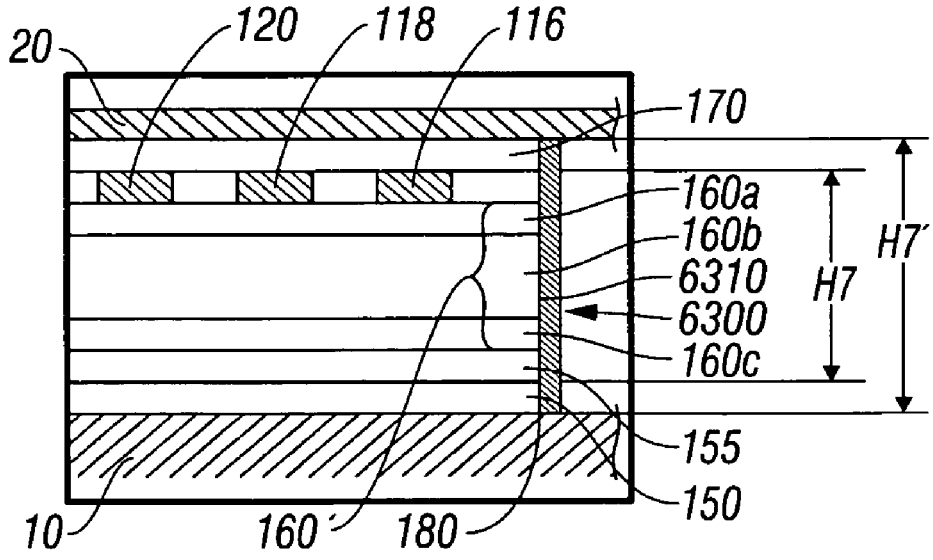
FIG. 7E is an enlarged view of another portion of the antenna assembly and housing assembly shown in FIG. 7C.

FIGS. 7C, 7D and 7E illustrate an alternate housing assembly 6300 for a non-air core antenna assembly 600*b*. Non-air core antenna assembly 600*b* is similar to non-air core antenna assembly 600*a* illustrated and described previously with respect to FIGS. 7, 7A and 7B. However, as compared to housing assembly 6100 which includes the internal compartment 190 disposed on the common planar surface 165 of the base insulating layer 160, housing assembly 6300 includes an internal compartment 290, analogous to internal compartment 190, with walls 290 having a periphery 295, that is now located below the transmitter antenna trace conductor 102. The transmitter antenna trace conductor 102 with first, second and third loops 116, 118 and 120, respectively, is again mounted on a common planar surface 165' of a base insulating layer 160'. The base layer 160' includes a first sub-layer 160*a*, a second sub-layer 160*c*, and an intermediate sub-layer 160*b* disposed therebetween. The periphery 295 of the internal compartment 290 is defined therein and the internal compartment 290 is also formed by the first and second sub-layers 160*a* and 160*c*. The internal compartment 290 enables receipt of the non-air core receiver antenna assembly 302. Again, the internal compartment 290 may be filled with filler insulation material 255 to minimize the probability of electrical shorting or EMI. The second sub-layer 160*c* of the base layer 160' is now disposed over the support or bottom insulating layer 150 with the dummy or filler insulating layer 155 disposed therebetween. However, the start end 276' and the finish end 278' of the wire loop 272 are now coupled to start end conductor layer portion 206' and from finish end conductor layer portion 207', respectively. Start end conductor layer portion 206' and finish end conductor layer portion 207' differ from start end conductor layer portion 206 and to finish end conductor layer portion 207, respectively, in that since the non-air core receiver antenna assembly 302 is not disposed on the same common planar surface as the transmitter antenna trace conductor 102, a cross-over or a cross-under of the transmitter antenna trace conductor 102 for the start end conductor layer portion 206' and finish end conductor layer portion 207' is not required.

Rather, referring to FIGS. 7, 7A and 7C, the start end 276' rises as a via connection 274 from the level of the dummy or filler insulating layer 155 through the second sub-layer 160*c* to the internal compartment 290, while, conversely, the finish end 278' descends as a via connection 274 from the internal compartment 290 through the second sub-layer 160*c* to the level of the dummy or filler insulating layer 155. If desired, before crossing under the first, second and third loops 116, 118 and 120 of the transmitter antenna trace conductor 102, the start end 206' may descend from the level of the common planar surface 165' on the base insulating layer 160'. The finish end 278' may remain on the level of the dummy or filler insulating layer 155. The wire loop 272 is electrically coupled to the start end conductor layer portion 206' through the start end 276' (see FIG. 7) and to the finish end conductor layer portion 207' through the finish end 278' (see FIG. 7) by via connections 274 which may pass to and from the internal compartment 290 to the level of the dummy or filler insulation layer 155.

Referring to FIGS. 7, 7C, 7D and 7E, it can be appreciated again that housing assembly 6300 is constructed in a similar manner to housing assemblies 1100 and 6100. More particularly, housing assembly 6300 includes an outer wall 6310 surrounding the antenna assembly 600*b* and inner walls 6320 of the internal compartment 290 within which specifically the receiver antenna assembly 302 is housed. The housing assembly 6300 may be hermetically sealed via joints 180 at the outer wall 6310.

In a similar manner to housing assembly 6100, the housing assembly 6300 further includes the series of mounting sleeves 1011 that are positioned as required in the portions of the housing assembly 6300 adjacent to the inner periphery 6125 of the internal compartment 290. Again, six mounting sleeves 1011 by way of example are illustrated in FIG. 7, one each in the vicinity of the four corners formed by the internal compartment 290 and the inner periphery 295 of the of the inner walls 6120, and one each midway in the lengthwise direction of housing assembly 6300 on either side of the inner periphery 6125.

As a result of construction using the thin film material, a height H7 is defined by the thickness of the base layer 160' and therefore the sum of the thicknesses of the first sub-layer 160*a*, the second sub-layer 160*c*, and the base sub-layer 160*b* disposed therebetween. The height H7 ranges up to about 15 mm. A total maximum height H7', which includes the thickness of the top cover or enclosure insulating layer, the thickness of the transmitter loop windings 116, 118 and 120, the base insulating layer 160' (which includes the internal compartment 290), the thickness of the filler insulating layer 155, and the thickness of the support insulating layer 150 ranges up to about 15.0 mm.

The dimensions for total maximum height H5', H6 and H7' as illustrated in FIGS. 7A, 7B and 7C are applicable to the antenna assemblies 600*a* and 600*b* such that the antenna assemblies 600*a* and 600*b* may be disposed between the subfloor 10 and the flooring or floor covering 20, without significantly altering the structural features of the floor or causing a deleterious effect to pedestrians or pedestrian traffic on the floor.

Figure 8:
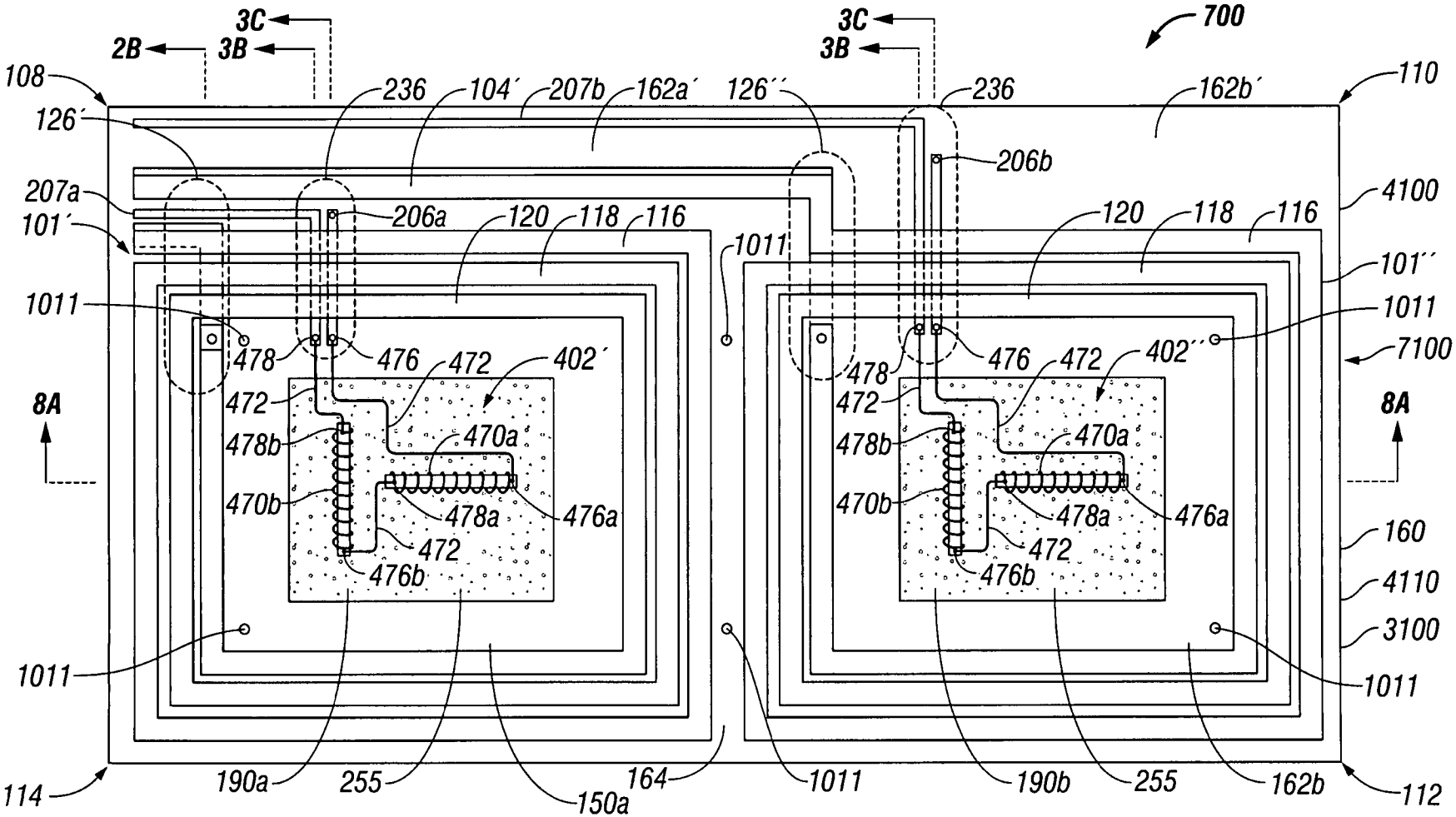
FIG. 8 is a plan view illustrating thin film conductors for an alternative antenna assembly having a pair of transmitter antenna assemblies each with an internal compartment for a non-air core receiver antenna assembly and partially illustrating a housing assembly according to the present disclosure.
Figure 8A:
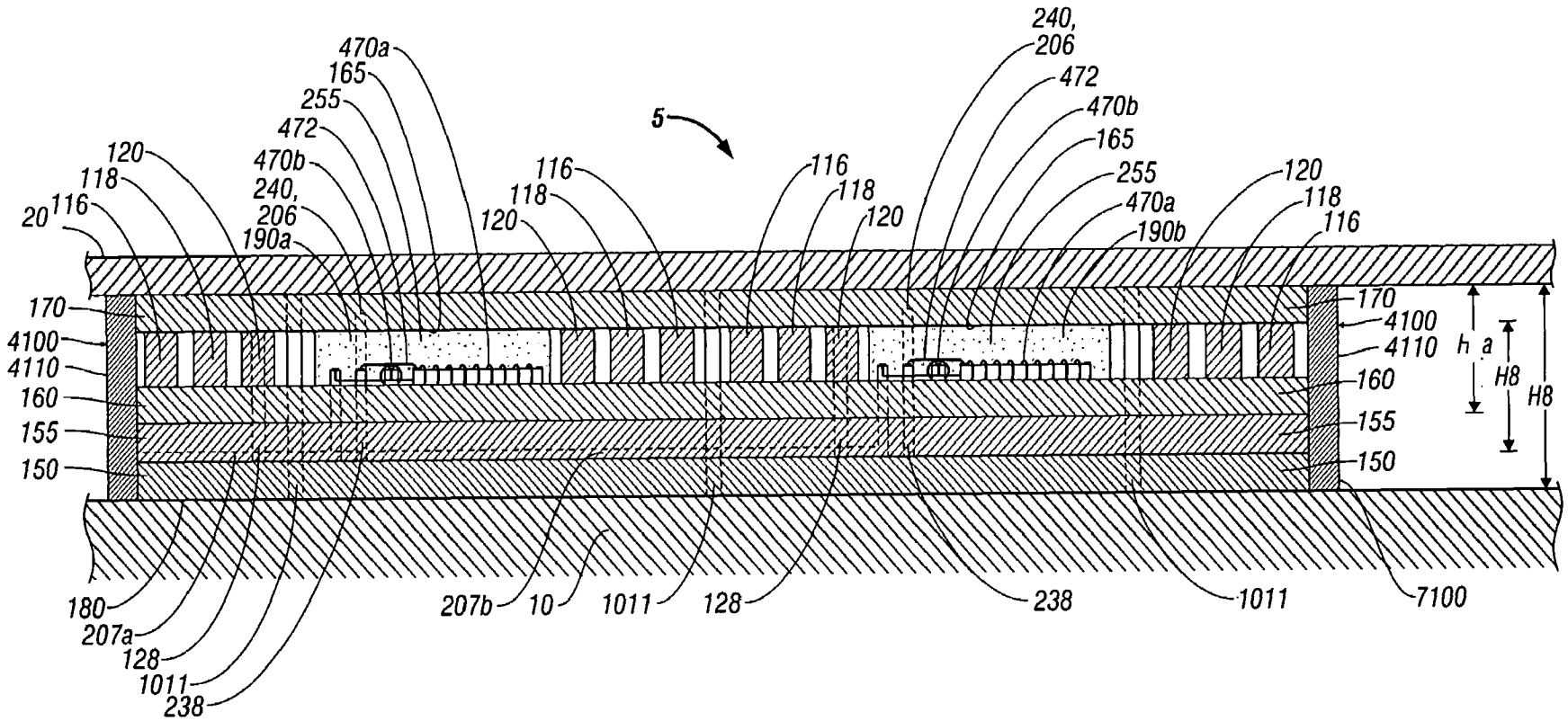
FIG. 8A is a cross-sectional elevation view of the antenna assembly of FIG. 8 with the housing assembly completely illustrated and taken along line 8A-8A of FIG. 8 and as disposed in a floor.

FIGS. 8 and 8A illustrate thin film conductors for still another embodiment of an alternative antenna assembly 700 and a housing assembly 7100 according to the present disclosure. Antenna assembly 700 and housing assembly 7100 are analogous to antenna assembly 400 and housing assembly 4100 described above with respect to FIGS. 4 and 4A, with the exception that antenna assembly 700 is a multiple non-air core antenna assembly with each assembly including a magnetic material receiver antenna housed in an internal compartment of the housing assembly, in a manner analogous to housing assemblies 6100, 6200 and 6300 and antenna assemblies 600*a* and 600*b* described above with respect to FIGS. 7, 7A, 7B and 7C. Again for purposes of simplification, FIG. 8 only partially illustrates the housing assembly 7100 housing the antenna assembly 700. More particularly, non-air core antenna assembly 700 includes a multiple set of the transmitter antenna 101' (see FIG. 2) and a receiver antenna 402' disposed on the common planar surface 165 of substrate or base insulating layer 160. Antenna 101' includes the antenna trace conductor 102 having start end conductor layer portion 104 and finish end conductor layer portion 106'.

As noted, antenna assembly 700 is similar to antenna assembly 400 so that a multiple set of antennas is disposed on the substrate or base insulating layer 160. More particularly, a first set which includes the single set of the transmitter antenna 101' and a receiver antenna 401' may be disposed at least partially or substantially on or over the first portion 162*a* of the common planar surface 165 of substrate or base insulating layer 160 while at the same time, a second set which includes the transmitter antenna 101" and receiver antenna 401", is disposed at least partially or substantially on or over the second portion 162*b* of the common planar surface 165 of substrate or base insulating layer 160.

In that the details of the transmitter antenna 101' and transmitter antenna 101" are the same as described above with respect to FIGS. 5 and 5A, the discussion herein is focused on the non-air core receiver antennas 401' and 401" and corresponding internal compartments 190*a* and 190*b*. Specifically, receiver start end conductor portions 206*a* and 206*b*, of receiver antennas 401' and 401", respectively, are coupled at joints 476 to receiver finish end conductor portions 207*a* and 207*b* at joints 478 via a long continuous wire loop 472 that again at least partially coils around at least one magnetic bar, e.g., first magnetic bar 470*a*. In particular, wire loop 472 extends from joint 476 to first end 476*a* of the first magnetic bar 470*a*. The wire 472 extends along the bar 470*a* and is coiled around the first magnetic bar 470*a* and extends to second end 478*a* of the first magnetic bar 470*a*. From the second end 478*a*, the wire 472 extends to first end 476*b* of a second magnetic bar 470*b* where again the wire 472 is coiled around the bar 470*b* and extends to second end 478*b*. From second end 278*b*, the wire 472 then completes the loop by extending from the second end 478*b* to the joint 478 of receiver finish end conductor portion 207*a* or 207*b*.

In a similar manner as described above with respect to FIG. 7, in conjunction with the start end conductor portions 206*a* and 206*b* and the finish end conductor portions 207*a* and 207*b*, the wire loops 472 and the start end conductor portions 206*a* and 206*b* and the finish end conductor portion 207*a* and 207*b* form a pair of non-air core receiver antenna assemblies 402' and 402" which may be at least partially disposed on or over the common planar surface 165 within the respective internal compartments 190*a* and 190*b*. Again, the non-air core receiver antenna assemblies 402' and 402" replace the air core receiver antenna assemblies 201' and 201" described previously with respect to FIG. 5. The internal compartments 190*a* and 190*b* may again be filled with filler insulating material 255 to prevent electrical shorting and electromagnetic interference (EMI) between the transmitter antenna assemblies 102' and 102" and the receiver antenna assembly 402' and 402", respectively.

As illustrated in FIG. 8A, the base insulating layer 160 may be disposed at least partially on or over the support insulating layer 150. The dummy or filler insulation material 155 may be disposed between the base insulating layer 160 and the support insulating layer 150. In a similar manner as shown in FIG. 7A, the start end conductor layer portions 206*a* and 206*b* cross under the transmitter windings 116, 118 and 120 through the via connections 238 and rise up to the vicinity of the covering surface 175 through the via connections 240. The finish end conductor layer portions 207*a* and 207*b*, having an L-shaped configuration, descend below the transmitter windings 116, 118 and 120 to the level of the filler insulation layer 155 where the finish end conductor layer portions 207*a* and 207*b* terminate.

In an analogous manner to housing assembly 6100 and antenna assembly 600*a* described above with respect to FIGS. 7 and 7A, in that the housing assembly 7100 includes the support or bottom insulating layer 150 and/or the enclosure insulating layer or top cover 170, a total maximum height H8', analogous to total maximum height H5', is defined by the thickness of the support or bottom insulating layer 150, the thickness of the dummy or filler insulating layer 155 over the support insulating layer 150, the base insulating layer 160 over the filler insulating layer 155, the thickness of the internal compartments 190*a* and/or 190*b*, or the transmitter loop windings 116, 118 and 120 over the base insulating layer 160, and the thickness of the enclosure insulating layer or top cover 170 over the internal compartment 190 or the transmitter loop windings 116, 118 and 120. The total maximum height H8' ranges up to about 15 mm. A height H8, analogous to the height H5 described above with respect to FIGS. 7 and 7A for antenna assembly 600*a*, is defined by the thickness of the internal compartments 190*a* and/or 190*b* on or over the common planar surface 165 or the thickness of the transmitter loop windings 116, 118 and 120 plus the thickness of the base insulating layer 160, and the thickness of the dummy or filler insulation layer 155. The height dimension H8 ranges up to about 12 mm.

In a similar manner to housing assembly 4100, the housing assembly 7100 further includes the series of mounting sleeves 1011 that are positioned as required in the portions of the housing assembly 7100 adjacent to the inner periphery 6125. Again, six mounting sleeves 1011 by way of example are illustrated in FIG. 7, one each in the vicinity of the two outermost corners formed by the internal compartments 190*a* and 190*b* and two each in a region 164 between the first and second portions 162*a* and 162*b* of the common planar surface 165 which generally separate the first transmitter antenna 101' from the second transmitter antenna 101", respectively. The installation procedure is otherwise again essentially the same as described previously with respect to housing assemblies 1100, 1200, 1100', and 1200'.

Again, although not shown, those skilled in the art will recognize that, and understand how, housing assembly 7100 may be constructed without the dummy or filler insulation 155 or the antenna assembly support insulating manner 160, so as to be analogous to housing assemblies 1200, 1200' or 2200. The embodiments are not limited in this context.

Similarly, the installation procedure for the housing assembly 7100 within the substructure or sub floor 10 and covering or floor covering 20 is otherwise essentially the same as described previously with respect to housing assemblies 1100, 1200, 1100', and 1200'.

As can be appreciated from the foregoing discussion, the housing assemblies 1100, 1100', 1200, 1200', 2100, 2200, 3100, 4100, 5100, 6100, 6200, 6300 and 7100 are mechanical structures that may be configured to hermetically enclose and seal the transmitter and receiver coils 102 and 202 of the antenna assemblies 100*a*, 100*b*, 100*a'*, 100*b'*, 200*a*, 200*b*, 300, 400, 500, 600 and 700 from the elements, thereby converting the antenna assemblies into antenna assembly units which are suitable for burial. The coils 102 may be mounted or inserted internally into the antenna assembly unit. The coils 102 and 202 (or 202*a* or 202*b*) may be in the form of conductive printing, copper tape, copper wire, or other suitable electrically conductive material. The entire housing assembly and antenna assembly unit may be configured to be anchored to a sub-floor or other location, as previously described, wherein usage of the antenna assembly unit is intended. The holes or ports in the housing assembly and antenna assembly unit may be disposed to allow sealing agents (thin-set, wood glue, or other suitable materials) to contact the top floor with the sub-floor.

The transmitter coil array of antenna trace conductor 102 may be driven by methods such as, but not limited to, a series—parallel hybrid or series only resonance approach. The discrete receiver array of antenna trace conductor 202 (or 202*a* or 202*b*) may be interpreted by methods such as, but not limited to, analyzing a ring down signal for a characteristic response. The embodiments are not limited in this context.

As noted previously, the designation of end conductor layer portion 104 as the start end conductor layer portion of transmit antenna 101 or 101' and the designation of end conductor layer portion 106 and end conductor layer portion 106' as the finish end conductor layer portion of transmitter antenna 101 or 101' are chosen arbitrarily for convenience of description only and end conductor layer portion 104 may also be described as the finish end conductor layer portion and conductor layer portion 106 and 106' may also be described as the start end conductor layer portion.

Similarly, the designation of end conductor layer portion 206 as the start end conductor layer portion of receive antenna 201 (see FIGS. 3 and 5) or 202*a* or 202*b* (see FIG. 4) and the designation of end conductor layer portion 207 or 207*a* or 207*b* as the finish end conductor layer portion of receive antenna 201 or 202*a* or 202*b*, respectively, are chosen arbitrarily for convenience of description only and end conductor layer portion 206 may also be described as the finish end conductor layer portion and end conductor layer portion 207 or 207*a* or 207*b* may also be described as the start end conductor layer portion.

The start end conductor layer portion 104 of the transmit antenna 101 or 101' and the finish end conductor layer portion 106 or 106' or the transmit antenna 101 or 101', respectively, are electrically coupled to a transmitter input controller (not shown) during operation. Similarly, the start end conductor layer portion 206 of the receive antenna 201 or 202*a* or 202*b* and the finish end conductor layer portion 207 or 207*a* or 207*b* of the receive antenna 201 or 202*a* or 202*b*, respectively are electrically coupled to a receiver input controller (not shown) during operation.

The foregoing designations of end conductor layer portion 104 as the start end conductor layer portion of transmit antenna 101 or 101' and the designation of end conductor layer portion 106 and end conductor layer portion 106' as the finish end conductor layer portion of transmitter antenna 101 or 101' in conjunction with the designation of end conductor layer portion 206 as the start end conductor layer portion of receive antenna 201 or 202*a* or 202*b* and the designation of end conductor layer portion 207 as the finish end conductor layer portion of air core receive antenna 201 or 202*a* or 202*b* (or their non-air core equivalents 600*a* or 600*b* or 700) permit tracking of phase angle shifts between the transmit antenna 101 or 101' and the air core receive antenna 201 or 202*a* or 202*b* (or their non-air core equivalents 600*a* or 600*b* or 700) during operation of the particular appropriate antenna assemblies 100, 100', 200*a* and 200*b*, 300, 400, 500, 600*a* and 600*b*, and 700.

The embodiments of the present disclosure provide a "thin film" antenna that does not require excavation of a sub-floor as compared to approaches known in the art that employ large (thick) antennas which require excavation into a floor.

In addition, while the embodiments of the present disclosure of a thin film antenna assembly and housing assembly are described as being applied for EAS or RFID systems, those skilled in the art will recognize that, and understand how, the embodiments may be applied for other types of electronic communications and surveillance systems with or without the use of an EAS or RFID label or tag, e.g., security or communications applied to travel or transportation terminals or buildings, or industrial, law enforcement, governmental, or counter terrorism security or communications and the like. The embodiments are not limited in this context.

While certain features of the embodiments of the invention have been illustrated as described herein, many modifications, substitutions, changes and equivalents may occur to those skilled in the art. It is, therefore, to be understood that the appended claims are intended to cover all such modifications and changes as fall within the true spirit of the embodiments of the invention.

What is claimed is:

1. An Electronic Article Surveillance ("EAS") antenna assembly for use in conjunction with a structure, the structure comprising a substructure and a covering, the EAS antenna assembly comprising:

a substrate comprising a first portion and a second portion, the substrate being a base insulating layer;

a first EAS transceiver antenna and a second EAS transceiver antenna, the first EAS transceiver antenna being disposed on the first portion of the substrate, the second EAS transceiver antenna being disposed on the second portion of the substrate in a co-planar orientation with respect to the first EAS transceiver antenna, the second EAS transceiver having one of an air core and a non-air core; and thin film materials forming said substrate, first EAS transceiver antenna and second EAS transceiver antenna such that the antenna assembly can be disposed between the substructure and the covering without altering a structural feature of the structure;

an enclosure insulating layer at least partially disposed on at least one of the first and second EAS transceiver antenna;

the antenna assembly being at least partially housed within a housing assembly, the housing assembly configured with thin film materials such that both the housing assembly and the antenna assembly can be disposed between the substructure and the covering.

2. The antenna assembly according to claim 1, wherein the base insulating layer comprises a common planar surface, and wherein at least one of the first and second EAS transceiver antennas is at least partially disposed on the common planar surface of the base insulating layer.

3. The antenna assembly according to claim 2, wherein the second EAS transceiver antenna is configured as a non-air core antenna and is substantially disposed in an internal compartment of one of (a) over the common planar surface of the base insulating layer and (b) within the base insulating layer.

4. The antenna assembly according to claim 1, wherein the antenna assembly further comprises a support insulating layer, the base insulating layer at least partially disposed on the support insulating layer.

5. The antenna assembly according to claim 4, further comprising a filler insulating layer at least partially disposed between the base insulating layer and the support insulating layer.

6. The antenna assembly according to claim 1, wherein at least one of first and second EAS transceiver antennas, comprises:

at least one antenna trace conductor including a start end conductor layer portion and a finish end conductor layer portion each having a thickness, wherein the finish end conductor layer portion crosses one of over and under the start end conductor layer portion to form an end crossover section of the antenna assembly, and wherein the end crossover section includes the antenna trace conductor and an antenna assembly base insulating layer having a thickness and disposed between the start end conductor layer portion and the finish end conductor layer portion.

7. The antenna assembly according to claim 1, wherein the housing assembly comprises the enclosure insulating layer, the base insulating layer and an outer wall along an outer periphery of the antenna assembly, the housing assembly at least partially housing the antenna assembly thereby.

8. The antenna assembly according to claim 7, wherein the housing assembly further comprises an inner wall along an inner periphery of the antenna assembly, the housing assembly at least partially housing the antenna assembly thereby.

9. The antenna assembly according to claim 1, wherein the housing assembly is configured such that the antenna assembly is hermetically sealed.

10. The antenna assembly according to claim 5, wherein the housing assembly comprises the enclosure insulating layer, the base insulating layer, the filler insulating layer, the support insulating layer, and an outer wall on an outer periphery of the antenna assembly.

11. The antenna assembly according to claim 10, wherein the housing assembly further comprises an inner wall along an inner periphery of the antenna assembly, the housing assembly at least partially housing the antenna assembly thereby.

12. The antenna assembly according to claim 1, wherein the antenna assembly has a total thickness not greater than substantially 1.3 millimeters (mm).

13. An Electronic Article Surveillance ("EAS") antenna assembly for use in conjunction with a structure, the structure comprising a substructure and a covering, the EAS antenna assembly comprising:

a substrate comprising a first portion and a second portion, the substrate being a base insulating layer;

a first EAS transceiver antenna and a second EAS transceiver antenna, the first EAS transceiver antenna being disposed on the first portion of the substrate, the second EAS transceiver antenna being disposed on the second portion of the substrate in a co-planar orientation with respect to the first EAS transceiver antenna, at least one of the first and second EAS transceiver antennas being disposed on a common planar surface of a base insulating layer, the second EAS transceiver being a non-air core transceiver antenna substantially disposed in an internal compartment of one of (a) over the common planar surface of the base insulating layer and (b) within the base insulating the base insulating layer having a thickness including:

a first sub-layer having a thickness;

a second sub-layer having a thickness; and a base sub-layer disposed there between having a thickness, wherein the base sub-layer includes the internal compartment defined therein formed by the first and second sub-layers; and thin film materials forming said substrate, first EAS transceiver antenna and second EAS transceiver antenna such that the antenna assembly can be disposed between the substructure and the covering without altering a structural feature of the structure.

14. An Electronic Article Surveillance (EAS) antenna assembly for use in conjunction with a structure, the structure comprising a substructure and a covering, the EAS antenna assembly comprising:

a substrate comprising a first portion and a second portion;

a first EAS transceiver antenna and a second EAS transceiver antenna and a receiver antenna, the first EAS transceiver antenna being disposed on the first portion of the substrate, the second EAS transceiver antenna being disposed on the second portion of the substrate in a co-planar orientation with respect to the first EAS transceiver antenna, the receiver antenna configured as a non-air core comprising a wire loop at least partially coiled around at least one bar of magnetic material formed in a thin-film construction; and thin film materials forming said substrate, the first EAS transceiver antenna and second EAS transceiver antenna such that the antenna assembly can be disposed between the substructure and the covering without altering a structural feature of the structure.

* * * * *